US011798489B2

(12) United States Patent
Son et al.

(10) Patent No.: US 11,798,489 B2
(45) Date of Patent: Oct. 24, 2023

(54) GATE DRIVER AND DISPLAY DEVICE USING THE SAME

(71) Applicant: LG Display Co., Ltd., Seoul (KR)

(72) Inventors: Ki Won Son, Paju-si (KR); Seok Noh, Paju-si (KR); Ki Min Son, Paju-si (KR); Seo Jun Yeom, Paju-si (KR)

(73) Assignee: LG DISPLAY CO., LTD., Seoul (KR)

( * ) Notice: Subject to any disclaimer, the term of this patent is extended or adjusted under 35 U.S.C. 154(b) by 0 days.

(21) Appl. No.: 17/859,852

(22) Filed: Jul. 7, 2022

(65) Prior Publication Data

US 2023/0008511 A1 Jan. 12, 2023

(30) Foreign Application Priority Data

Jul. 8, 2021 (KR) ..... 10-2021-0090008
Dec. 3, 2021 (KR) ..... 10-2021-0171603

(51) Int. Cl.
*G09G 3/3266* (2016.01)
*G09G 3/3291* (2016.01)
*G09G 3/3233* (2016.01)

(52) U.S. Cl.
CPC ..... *G09G 3/3266* (2013.01); *G09G 3/3233* (2013.01); *G09G 3/3291* (2013.01); *G09G 2300/0426* (2013.01); *G09G 2300/0852* (2013.01)

(58) Field of Classification Search
CPC .. G09G 3/3266; G09G 3/3233; G09G 3/3291; G09G 2300/0426; G09G 2300/0852
See application file for complete search history.

(56) References Cited

U.S. PATENT DOCUMENTS

2018/0121023 A1* 5/2018 Kim ..... G06F 3/0412
2021/0287609 A1* 9/2021 An ..... G09G 3/3291
2021/0358392 A1* 11/2021 Ikeda ..... G09G 3/2081

FOREIGN PATENT DOCUMENTS

CN 112331156 A 2/2021
EP 3 264 417 A1 1/2018
EP 4 116 964 A1 1/2023
KR 10-2019-0012444 A 2/2019
KR 10-2020-0058206 A 5/2020
KR 10-2020-0060903 A 6/2020
WO WO 2011/145668 A 11/2011

* cited by examiner

*Primary Examiner* — Premal R Patel
(74) *Attorney, Agent, or Firm* — Birch, Stewart, Kolasch & Birch, LLP

(57) ABSTRACT

A gate driver according to an embodiment and a display device using the same are discussed. The gate driver can output a gate signal to a pixel circuit having a driving element connected between a first power line and a first node, a light-emitting element connected between the first node and a second power line, and a switching element connected between the first node and a third power line and driven by the gate signal. The gate driver includes a first circuit unit to receive a carry signal from a previous signal transmission unit to charge or discharge a first control node and a second control node, and a second circuit unit having a first buffer transistor and a second buffer transistor configured to output the gate signal based on a first clock signal and a first low potential voltage according to potentials of the first and second control nodes.

19 Claims, 22 Drawing Sheets

GATE DRIVER AND DISPLAY DEVICE USING THE SAME

CROSS-REFERENCE TO RELATED APPLICATION

This application claims priority to and the benefit under 35 U.S.C. § 119(a) to Korean Patent Application No. 10-2021-0090008, filed on Jul. 8, 2021, and Korean Patent Application No. 10-2021-0171603, filed on Dec. 3, 2021, the entire contents of all these applications are hereby expressly incorporated by reference into the present application.

BACKGROUND

1. Field of the Invention

The present disclosure relates to a gate driver and a display device using the same.

2. Discussion of Related Art

Display devices includes a liquid crystal display (LCD) device, an electroluminescence display device, a field emission display (FED) device, a plasma display panel (PDP), and the like.

Electroluminescent display devices are divided into inorganic light emitting display devices and organic light emitting display devices according to a material of a light emitting layer. An active-matrix type organic light emitting display device reproduces an input image using a self-emissive element which emits light by itself, for example, an organic light emitting diode (OLED). An organic light emitting display device has advantages in that a response speed is fast and luminous efficiency, luminance, and a viewing angle are large.

Some of display devices, for example, a liquid crystal display device or an organic light emitting display device include a display panel including a plurality of sub-pixels, a driver outputting a driving signal for driving the display panel, a power supply generating power to be supplied to the display panel or the driver, and the like. The driver includes a gate driver that supplies a scan signal or a gate signal to the display panel, and a data driver that supplies a data signal to the display panel.

In such a display device, when a driving signal such as a scan signal, an EM signal, and a data signal is supplied to a plurality of sub-pixels formed in the display panel, the selected sub-pixel transmits light or emits light directly to thereby display an image.

Each sub-pixel includes a driving thin film transistor (TFT) which controls a current flowing through a light-emitting element and one or more switch TFTs which switch the current. In this case, deterioration due to long-time driving of the driving TFT may occur, and a current sensing-based compensation method can be applied to compensate for this deterioration. However, although the current sensing-based compensation method operates in a time in which a user is not watching, it can have a limitation in that an organic light-emitting diode (OLED) may be recognized as a structure of emitting light.

SUMMARY OF THE DISCLOSURE

The present disclosure is directed to address all the above-described necessity and problems.

The present disclosure is directed to providing a gate driver and a display device using the same.

It should be noted that objects of the present disclosure are not limited to the above-described objects, and other objects of the present disclosure will be apparent to those skilled in the art from the following descriptions.

A gate driver according to the present disclosure configured to output a gate signal to a pixel circuit having a driving element connected between a first power line and a first node, a light-emitting element connected between the first node and a second power line, and a switching element connected between the first node and a third power line to be driven by the gate signal, can include a first circuit unit configured to receive a carry signal from a previous signal transmission unit to charge or discharge a first control node and a second control node, and a second circuit unit having a first buffer transistor and a second buffer transistor configured to output the gate signal based on a first clock signal and a first low potential voltage according to potentials of the first control node and the second control node, wherein the first low potential voltage has a high level voltage when driving in a sensing mode.

A display device according to the present disclosure can include a data driver configured to output a data voltage, a gate driver including a first circuit unit configured to receive a carry signal from a previous signal transmission unit and charge a first control node or a second control node and a second circuit unit configured to output a gate signal based on a clock signal and a low potential voltage according to potentials of the first control node and the second control node; and a plurality of pixel circuits configured to receive the data voltage and the gate signal to reproduce an input image, wherein, when driving in a sensing mode, the second circuit unit outputs the gate signal based on a first clock signal and a first low potential voltage, the first low potential voltage has a high level voltage, and the pixel circuit includes a driving element connected between a first power line and a first node, a light-emitting element connected between the first node and a second power line, and a switching element connected between the first node and a third power line to be driven by the gate signal.

BRIEF DESCRIPTION OF THE DRAWINGS

The above and other objects, features and advantages of the present disclosure will become more apparent to those of ordinary skill in the art by describing in detail exemplary embodiments thereof with reference to the accompanying drawings, in which.

DETAILED DESCRIPTION OF THE EMBODIMENTS

Figure 1:
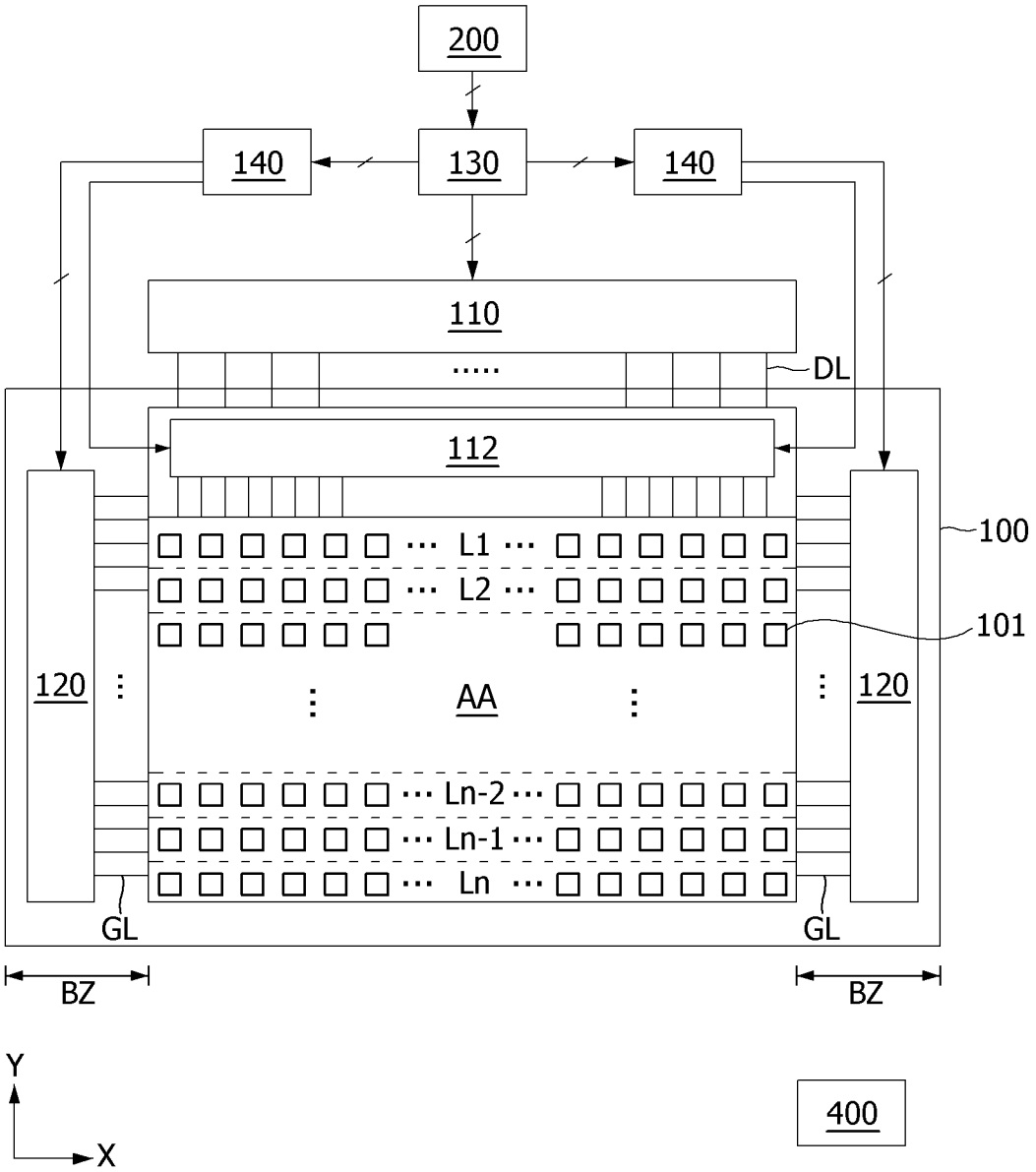
FIG. 1 is a block diagram illustrating a display device according to an embodiment of the present disclosure.

The advantages and features of the present disclosure and methods for accomplishing the same will be more clearly understood from embodiments described below with reference to the accompanying drawings. However, the present disclosure is not limited to the following embodiments but can be implemented in various different forms. Rather, the present embodiments will make the disclosure of the present disclosure complete and allow those skilled in the art to completely comprehend the scope of the present disclosure. The present disclosure is only defined within the scope of the accompanying claims.

The shapes, sizes, ratios, angles, numbers, and the like illustrated in the accompanying drawings for describing the embodiments of the present disclosure are merely examples, and the present disclosure is not limited thereto. Like reference numerals generally denote like elements throughout the present specification. Further, in describing the present disclosure, detailed descriptions of known related technologies can be omitted to avoid unnecessarily obscuring the subject matter of the present disclosure.

The terms such as "comprising," "including," "having," and "consist of" used herein are generally intended to allow other components to be added unless the terms are used with the term "only." Any references to singular can include plural unless expressly stated otherwise.

Components are interpreted to include an ordinary error range even if not expressly stated.

When the position relation between two components is described using the terms such as "on," "above," "below," and "next," one or more components can be positioned between the two components unless the terms are used with the term "immediately" or "directly."

The terms "first," "second," and the like can be used to distinguish components from each other, but the functions or structures of the components are not limited by ordinal numbers or component names in front of the components.

The same reference numerals can refer to substantially the same elements throughout the present disclosure.

The following embodiments can be partially or entirely bonded to or combined with each other and can be linked and operated in technically various ways. The embodiments can be carried out independently of or in association with each other.

Hereinafter, various embodiments of the present disclosure will be described in detail with reference to the accompanying drawings. All components of each display device according to all embodiments of the present disclosure are operatively coupled and configured.

FIG. 1 is a block diagram illustrating a display device according to an embodiment of the present disclosure.

Referring to FIG. 1, the display device according to the embodiment of the present disclosure includes a display panel 100 and a display panel driving circuit.

The display panel 100 includes a pixel array AA that displays an input image. Pixel data of an input image is displayed on pixels 101 of a pixel array AA. The pixel array AA includes a plurality of data lines 102, a plurality of gate lines 103 intersected with the data lines 102, and pixels arranged in a matrix form. Arrangement forms of the pixels 101 can include various forms such as a form in which pixels that emit the same color are shared, a stripe form, a diamond form, and the like in addition to a matrix form.

When a resolution of the pixel array AA is n*m, the pixel array AA includes n pixel columns and m pixel lines L1 to Lm crossing the pixel columns. The pixel columns include pixels disposed in a y-axis direction. The pixel lines include pixels disposed in an x-axis direction. One horizontal period 1H is a time in which one frame period is divided into the number of m pixel lines L1 to Lm. The pixel data is written to the pixels of one pixel line in one horizontal period 1H. Here, n and m can be positive numbers such as positive integers.

To implement color, each of the pixels can be divided into a red sub-pixel (hereinafter referred to as "R sub-pixel"), a green sub-pixel (hereinafter referred to as "G sub-pixel"), and a blue sub-pixel (hereinafter referred to as "B sub-pixel"). Each of the pixels can further include a white sub-pixel. Each of the sub-pixels 101 includes a pixel circuit. A pixel circuit includes a pixel electrode, a plurality of thin film transistors (TFTs), and a capacitor. The pixel circuit is connected to the data line DL and the gate line GL.

Touch sensors can be disposed on the display panel 100 to implement a touch screen. A touch input can be sensed using separate touch sensors or can be sensed through pixels. The touch sensors can be disposed as an on-cell type or an add-on type on the screen of the display panel or implemented as in-cell type touch sensors embedded in the pixel array AA.

The display panel driving circuit includes a data driver 110, a gate driver 120, and a timing controller 130 for controlling operation timings of the drivers 110 and 120. The display panel driving circuit writes pixel data (digital data) of an input image to the pixels of the display panel 100 under the control of a timing controller (TCON) 130.

The data driver 110 converts pixel data V-DATA of the input image received as a digital signal from the timing controller 130 for every frame to an analog gamma compensation voltage to output data signals Vdata1 to Vdata3. The data driver 110 supplies the data signals Vdata1 to Vdata3 to data lines DL. The data driver 110 outputs the data signals Vdata1 to Vdata3 using a digital-to-analog converter (hereinafter referred to as "DAC") which converts the digital signal to the analog gamma compensation voltage.

The gate driver 120 can be formed in a bezel region BZ where an image is not displayed in the display panel 100. The gate driver 120 receives a gate timing control signal received from a level shifter 140 to generate gate signals (or scan signals) GATE1 to GATE3 and supply the gate signals to gate lines GL. The gate signals GATE1 to GATE3 applied to the gate lines GL turn on switch elements of sub-pixels to select pixels to which voltages of the data signals Vdata1 to Vdata3 are charged. The gate signals GATE1 to GATE3 can be generated as pulse signals swinging between a gate high voltage VGH and a gate low voltage VGL. The gate driver 120 shifts the gate signal using a shift register.

The timing controller 130 multiplies an input frame frequency by i and controls the operation timing of the display panel driving circuit with a frame frequency of the input frame frequency×i (i is a positive integer greater than 0) Hz. The input frame frequency is 60 Hz in the NTSC (National Television Standards Committee) scheme and 50 Hz in the PAL (Phase-Alternating Line) scheme.

The timing controller 130 receives, from a host system 200, pixel data of an input image and a timing signal synchronized therewith. The pixel data of the input image received by the timing controller 130 is a digital signal. The timing controller 130 transmits the pixel data to the data driver 110. The timing signal includes a vertical synchronization signal Vsync, a horizontal synchronization signal Hsync, a main clock CLK, a data enable signal DE, and the like. Because a vertical period and a horizontal period can be known by counting the data enable signal DE, the vertical synchronization signal Vsync and the horizontal synchronization signal Hsync can be omitted. The data enable signal DE has a cycle of one horizontal period (1H).

The display panel driving circuit can further include a de-multiplexer (DEMUX) 112 disposed between the data driver 110 and the gate driver 120. The de-multiplexer 112 sequentially connects one channel of the data driver 110 to the plurality of data lines 102 and distributes in a time division manner the data voltage outputted from one channel of the data driver 110 to the data lines 102, thereby reducing the number of channels of the data driver 110.

The timing controller 130 can generate a data timing control signal for controlling the data driver 110, a gate timing control signal for controlling the gate driver 120, a MUX control signal for controlling switch elements of a demultiplexer array 112, and the like, based on the timing signal received from a host system 200. The gate timing control signal can include a start pulse (gate start pulse) VST, a shift clock GCLK, and the like. The start pulse VST controls a start timing of the gate driver 120 in every frame period. The shift clock GCLK controls a shift timing of the gate signal output from the gate driver 120. The timing controller 130 can generate a control signal for controlling the level shifter 140.

The host system 200 can be any one of a television (TV), a set-top box, a navigation system, a personal computer (PC), a home theater, a mobile system, and a wearable system. In a mobile device and a wearable device, the data driver 110, the timing controller 130, the level shifter 140, and the like can be integrated into one drive IC.

In the mobile system, the host system 200 can be implemented as an application processor (AP). The host system 200 can transmit the pixel data of the input image to the drive IC through a mobile industry processor interface (MIPI). The host system 200 can be connected to the drive IC through a flexible printed circuit, for example, a flexible printed circuit (FPC).

The level shifter 140 converts a voltage of the control signal received from the timing controller 130. For example, the level shifter 140 converts a high logic voltage (or high potential input voltage) of an input signal received as a digital signal voltage level to the gate high voltage VGH, and converts a low logic voltage (or low potential input voltage) of the input signal to the gate low voltage VGL.

The output signal of the level shifter 140 can be applied to at least one of the demultiplexer array 112, the gate driver 120, the data driver 110, a touch sensor driver, and a power unit 400.

The display device of the present disclosure further includes the power unit 400.

The power unit 400 generates DC power required for driving the pixel array AA and the display panel driving circuit of the display panel 100 by using a DC-DC converter. The DC-DC converter can include a charge pump, a regulator, a buck converter, a boost converter, buck-boost converter, and the like. The power unit 400 adjusts a DC input voltage from the host system 200 to generate a DC voltage such as a gamma reference voltage VGMA, gate high voltages VGH and VEH, gate low voltages VGL and VEL, a half VDD HVDD, a common voltage of the pixels, or the like. The gamma reference voltage VGMA is supplied to the data driver 110. A half VDD voltage is a half voltage compared to a VDD and can be used as an output buffer driving voltage of the source drive IC. The gamma reference voltage VGMA is divided for each gray level through a voltage dividing circuit and is supplied to the DAC of the data driver 110.

Figure 2:
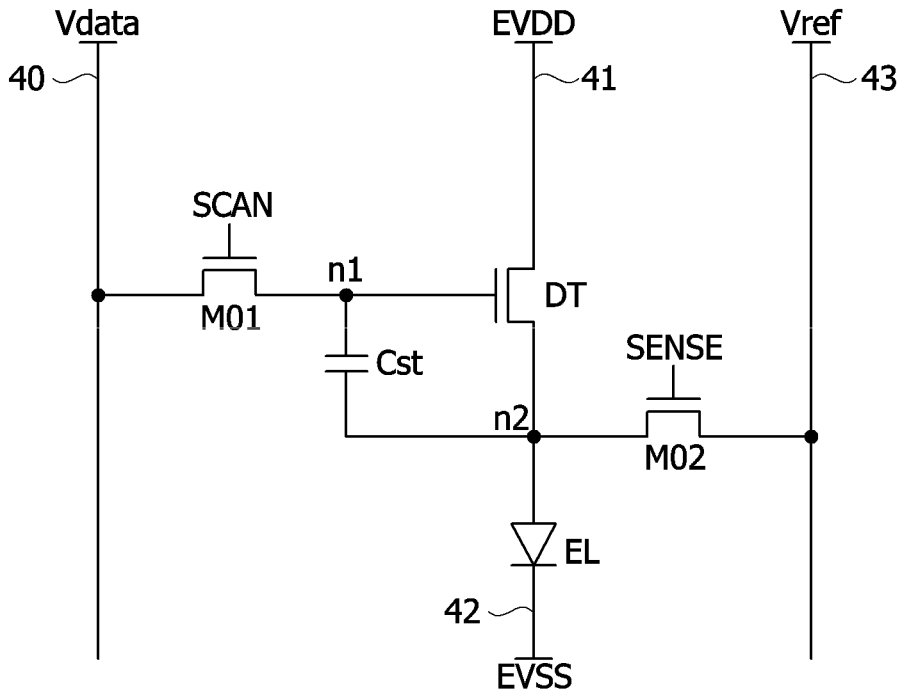
FIG. 2 is a circuit diagram illustrating a pixel circuit connected to an external compensation circuit of the present disclosure.

FIG. 2 is a circuit diagram illustrating the pixel circuit connected to the external compensation circuit of the present disclosure.

Referring to FIG. 2, the pixel circuit includes a light-emitting element EL, a driving element DT which supplies a current to the light-emitting element EL, a first switch element M01 which connects a data line 40 in response to a scan pulse SCAN, a capacitor Cst connected to a gate electrode of the driving element DT, and a second switch element M02 which connects a reference voltage line 43 in response to a sensing pulse SENSE.

A pixel driving voltage for example, high potential voltage EVDD is applied to a first electrode of the driving element DT through a high potential voltage line 41. The driving element DT drives the light emitting element OLED by supplying a current to the light emitting element OLED according to a gate-source voltage Vgs. The light emitting element OLED is turned on and emits light when a forward voltage between an anode and a cathode is greater than or equal to a threshold voltage. A low potential voltage EVSS is applied to a cathode of the light-emitting element EL. The capacitor Cst is connected between the gate electrode and a second electrode of the driving element DT to maintain a gate-source voltage Vgs of the driving element DT.

The first switch element M01 is turned on according to a gate-on voltage of the scan pulse SCAN applied from a gate line and connects the data line 40 to the gate electrode of the driving element DT and the capacitor Cst.

The second switch element M02 applies a reference voltage Vref in response to the scan pulse SCAN or a separate sensing pulse SENSE. The reference voltage Vref is applied to the pixel circuit through the reference voltage line 43.

The light-emitting element EL can be implemented as an OLED. The OLED includes an organic compound layer formed between an anode and a cathode. The organic compound layer can include a hole injection layer (HIL), a hole transport layer (HTL), a light-emitting layer (EML), an electron transport layer (ETL), an electron injection layer (EIL), and the like, but is not limited thereto. The switch elements M01 and M02 can be implemented as n-channel oxide thin film transistors (TFTs).

An organic light emitting diode used as the light emitting element can have a tandem structure in which a plurality of light emitting layers are stacked. The organic light emitting diode having the tandem structure can improve the luminance and lifespan of the pixel.

In a sensing mode, a current flowing through a channel of the driving element DT or a voltage between the driving element DT and the light emitting element OLED is sensed through the reference voltage line 43. The current flowing through the reference voltage line 43 is converted to a voltage through an integrator and is converted to digital data through an analog-to-digital converter (ADC). This digital data is sensing data including a threshold voltage or mobility information of the driving element DT. The sensing data is transmitted to a data operation unit. The data operation unit can receive the sensing data from the ADC to compensate for driving deviation and deterioration of the pixels by adding or multiplying a compensation value selected based on the sensing data to the pixel data.

FIGS. 3 to 7 are views for describing an operation principle of a sensing circuit according to the embodiment.

Figure 3:
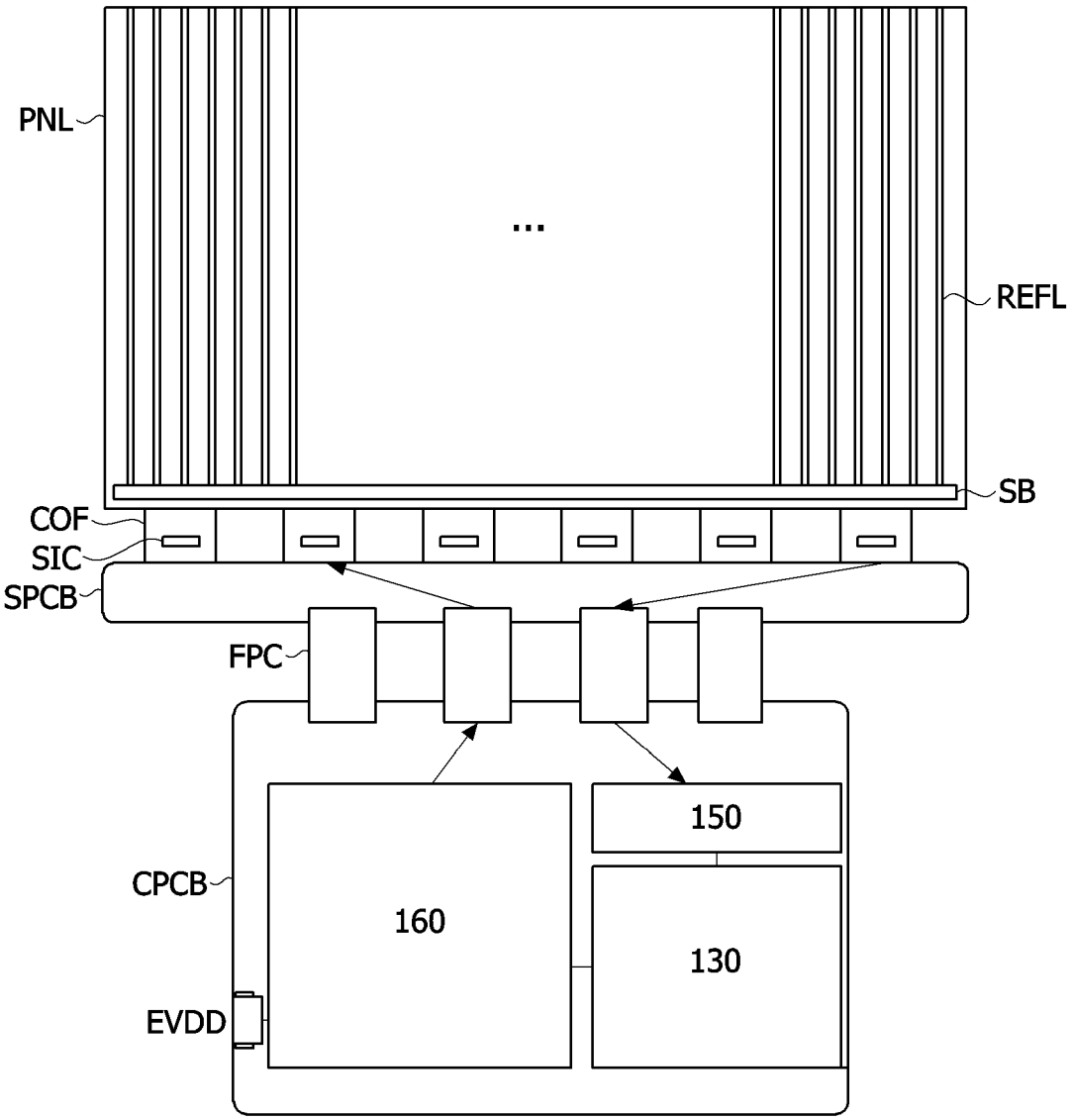
FIGS. 3 to 7 are views for describing an operation principle of a sensing circuit according to the embodiment.

Referring to FIG. 3, a chip on film (COF) can be adhered to a display panel PNL. The COF includes a drive IC SIC and connects a source PCB (SPCB) to the display panel PNL. The drive IC SIC includes a data driver.

The timing controller 130 and a power unit 150 can be mounted on a control PCB CPCB. The control PCB CPCB can be connected to the source PCB SPCB through a flexible circuit film, for example, a flexible printed circuit (FPC).

The timing controller 130 can adjust the reference voltage Vref output from the power unit 150 on the basis of a result of comparing the reference voltage Vref sensed from the display panel PNL and the reference voltage Vref output from the power unit 150 by including the above-described reference voltage controller.

The reference voltage Vref output from the power unit 150 can be supplied to the display panel PNL via the FPC, the source PCB SPCB, and the COF. Accordingly, in the display panel PNL, a lead-in part IN of the reference voltage Vref is close to the drive IC SIC.

Reference voltage lines REFL on the display panel PNL can be connected to the power unit 150 via the COF, the SPCB, and the FPC. The reference voltage lines REFL can be grouped by a shorting bar SB. The shorting bar can be formed on one side of the display panel PNL, and can be formed as a line on glass (LOG) line on the display panel rather than in the drive IC SIC. The reference voltage lines REFL connected to all pixels on the display panel PNL can be connected to the shorting bar.

A sensing unit 160 senses a current flowing through a pixel power line to which a high potential voltage EVDD is applied when driving in a sensing mode after the power is turned off. The sensing unit 160 provides the sensed current to the timing controller 130.

Figure 5:
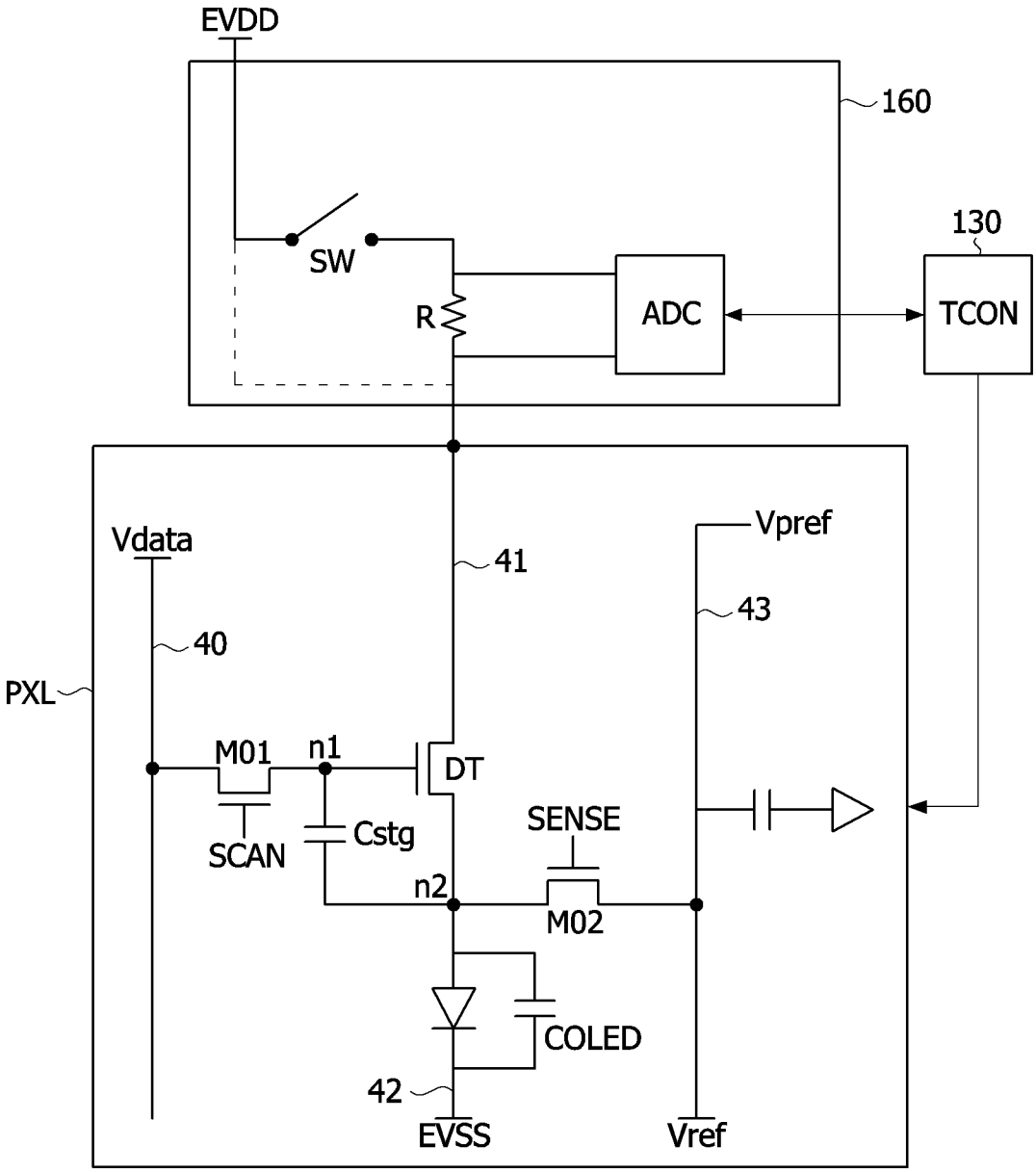

Referring to FIG. 5, the sensing unit can include a resistor connected to the pixel power line and an analog-to-digital converter (ADC) connected to the resistor. The sensing unit can further include a switch connected between the pixel power line and the resistor. The switch is turned off in a display mode and turned on in the sensing mode.

When a switch SW is turned off in the display mode, the high potential voltage EVDD is applied to a pixel PXL through the pixel power line. When the switch SW is turned on in the sensing mode, the high potential voltage is applied to the pixel through the pixel power line and a resistor R, and the current flowing through the resistor is sensed.

Figure 4:
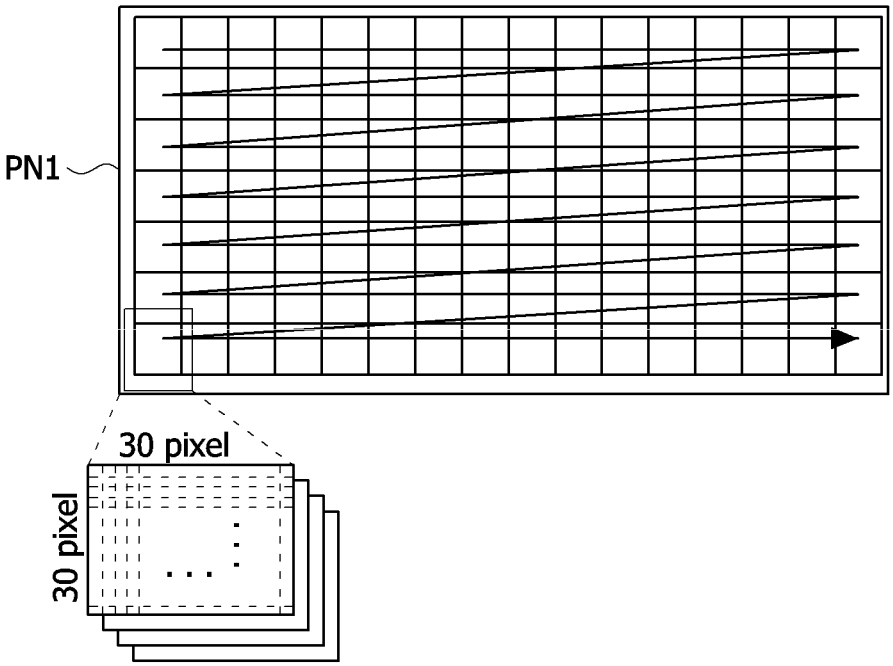

Referring to FIG. 4, the sensing unit senses the current in units of blocks including a predetermined number of pixels. Here, the block can have a square shape in which the number of pixels in a line direction X and the number of pixels in a column direction Y are the same, for example, a square shape of 30 pixels×30 pixels. The block is not limited to the square shape and can be implemented in various shapes.

The sensing unit senses the current in units of blocks, and senses the current flowing through each block in a predetermined order. Different currents are sensed according to characteristics and deterioration levels of pixels included in each block.

A method of sensing the current in units of blocks can decrease an overall sensing time compared to a method of sensing the current in units of pixels, and can be realized in a simple structure.

Figure 6A:
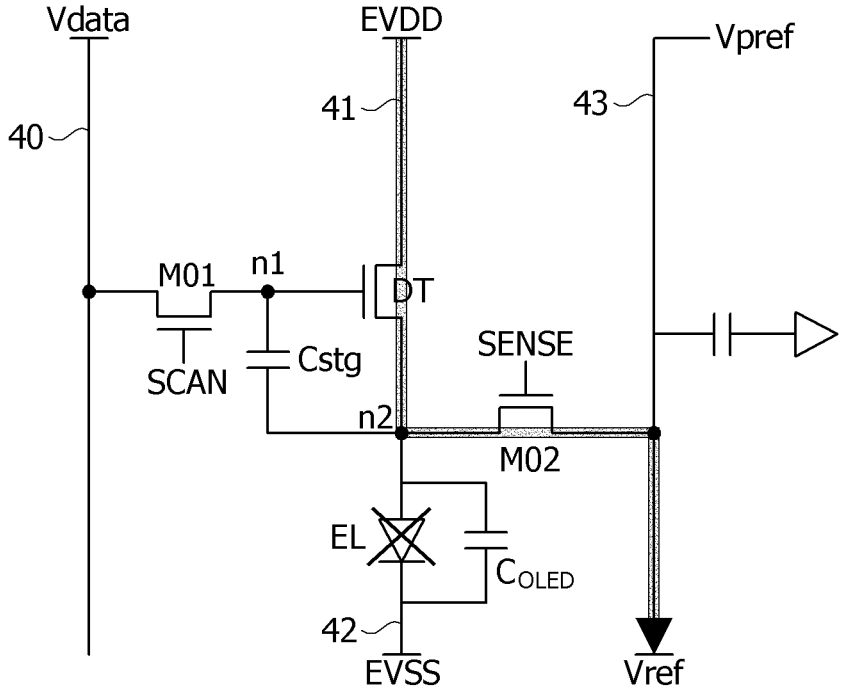
Figure 6A:
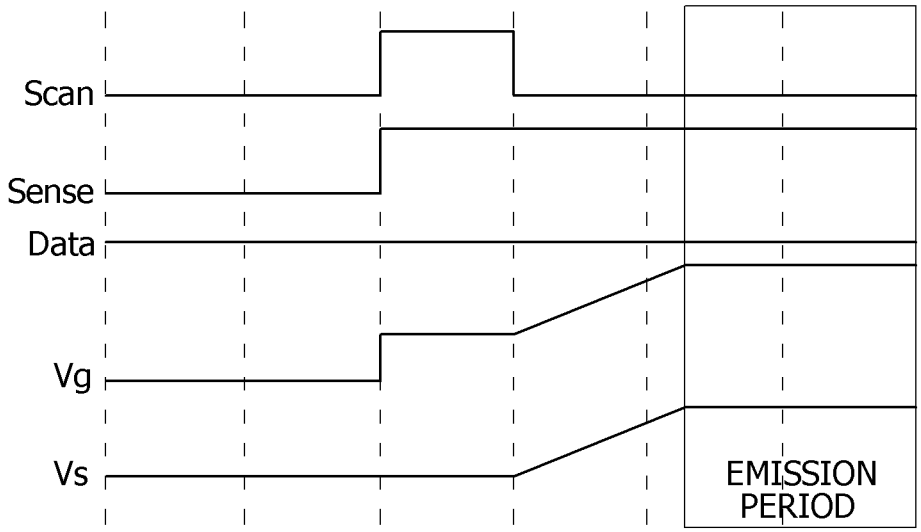

Referring to FIG. 6A, in the embodiment, a gate-on voltage of a sensing pulse SENSE is applied to a second switch element when driving in a sensing mode. The second switch element is turned on when the gate-on voltage is applied to form a current path through which the current flowing through a pixel driving voltage line 41 flows through a reference voltage line 43 instead of flowing to the light-emitting element. Accordingly, current sensing can be possible without emitting light from the light-emitting element.

Figure 6B:
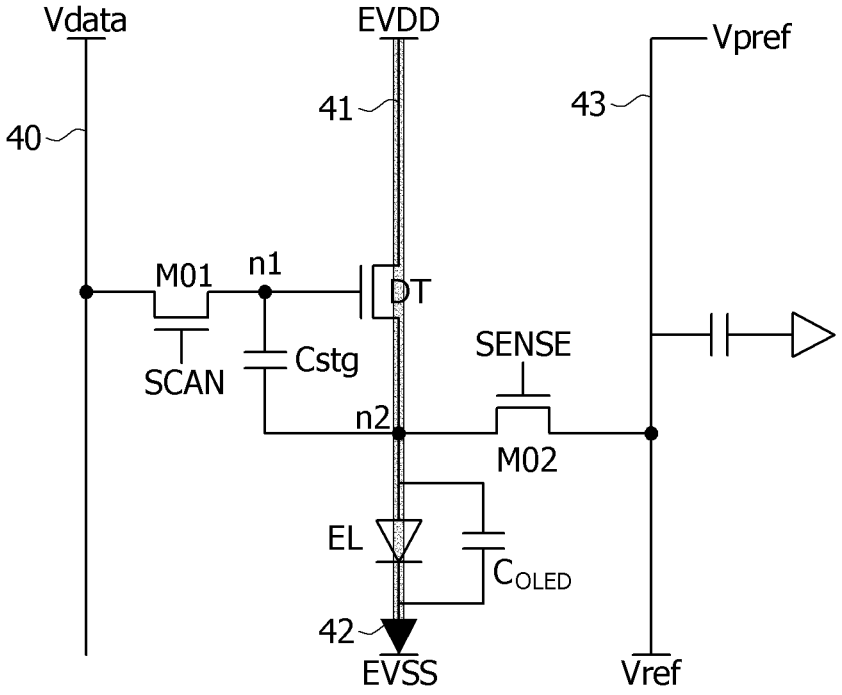
Figure 6B:
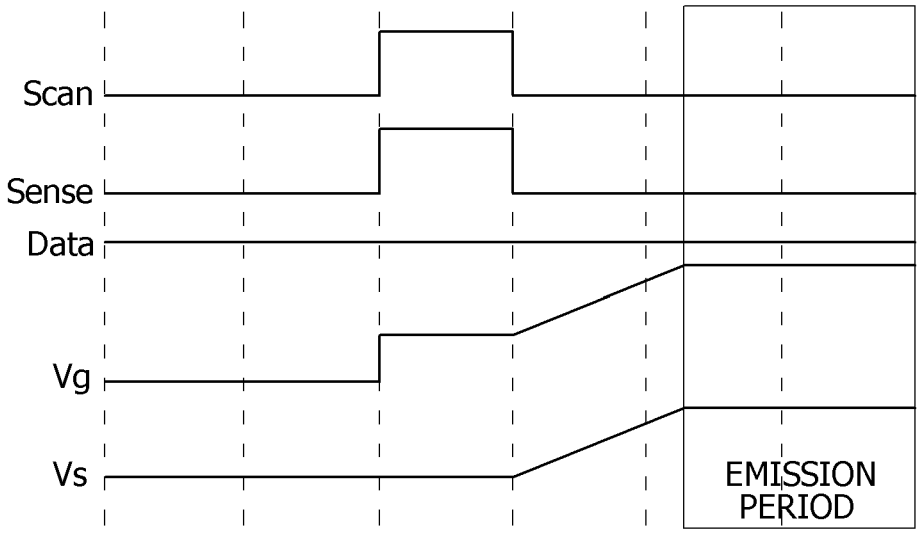

Referring to FIG. 6B, in a comparative example, a gate-off voltage of the sensing pulse is applied to the second switch element in the sensing mode. Since the second switch element is turned off when the gate-off voltage is applied, the current flowing through the pixel driving voltage line 41 is applied to the light-emitting element, and thus the light-emitting element emits light. When the light-emitting element emits the light after power is turned off, a user can notice the light.

Accordingly, it is possible to measure a current flowing through a pixel power line without causing the light emitting element to emit light by driving a sensing transistor and changing the current path when driving in the sensing mode.

Figure 7:
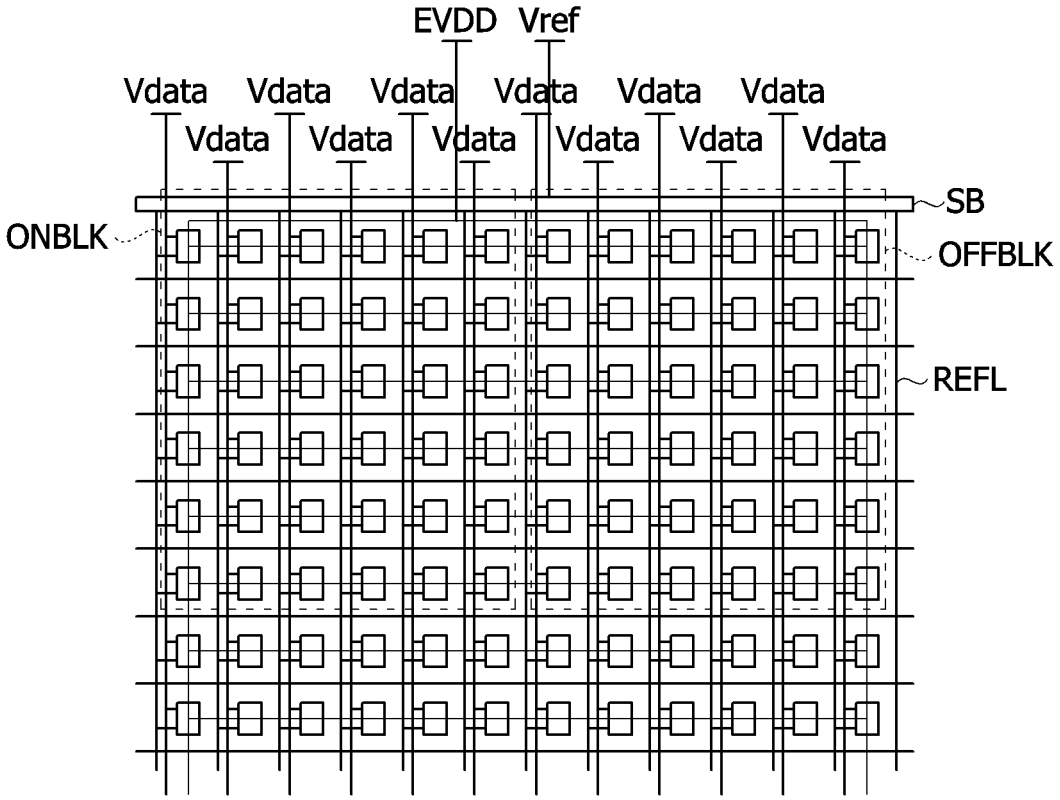

Referring to FIG. 7, the embodiment shows a pixel structure for sensing the current in units of blocks. The reference voltage line and a high potential voltage line are connected to all pixels on the display panel to be shared, and a data voltage line is connected to each of the pixels in the column direction Y.

As such, even when the reference voltage and the high potential voltage are applied to all pixels on the display panel, it is possible to select a block in which sensing is performed according to whether data is applied. For example, white data is applied to all pixels in a first block ONBLK in which sensing is performed, and black data is applied to all pixels in a second block OFFBLK in which the sensing is not performed.

Here, while the white data is applied to one block on the display panel, the black data is applied to the remaining blocks.

When the white data is applied to all pixels in the first block to be sensed, the sensing unit senses the current flowing through the pixel driving voltage line. In this case, since the current flowing through the pixel driving voltage line has a large value in units of blocks, an integrator is not required in the sensing unit.

Figure 8:
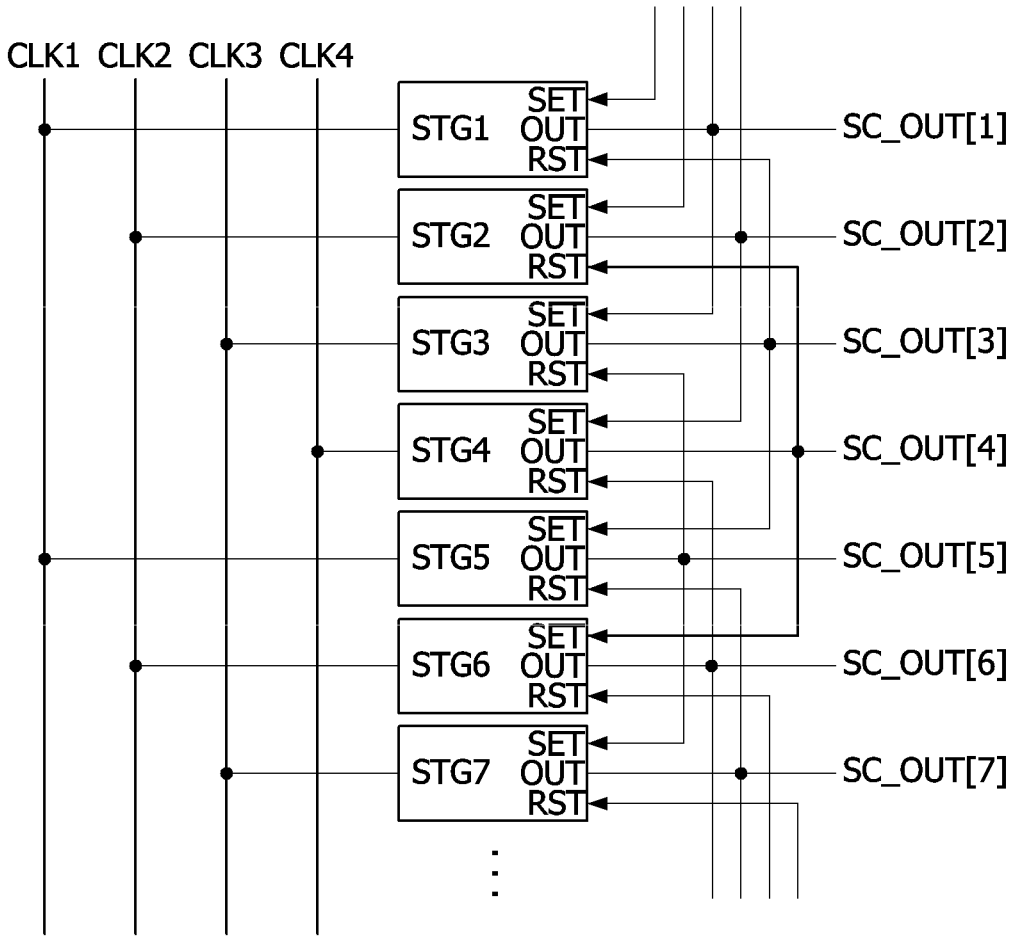
FIG. 8 is a view schematically illustrating a gate driver according to the embodiment of the present disclosure.
Figure 9:
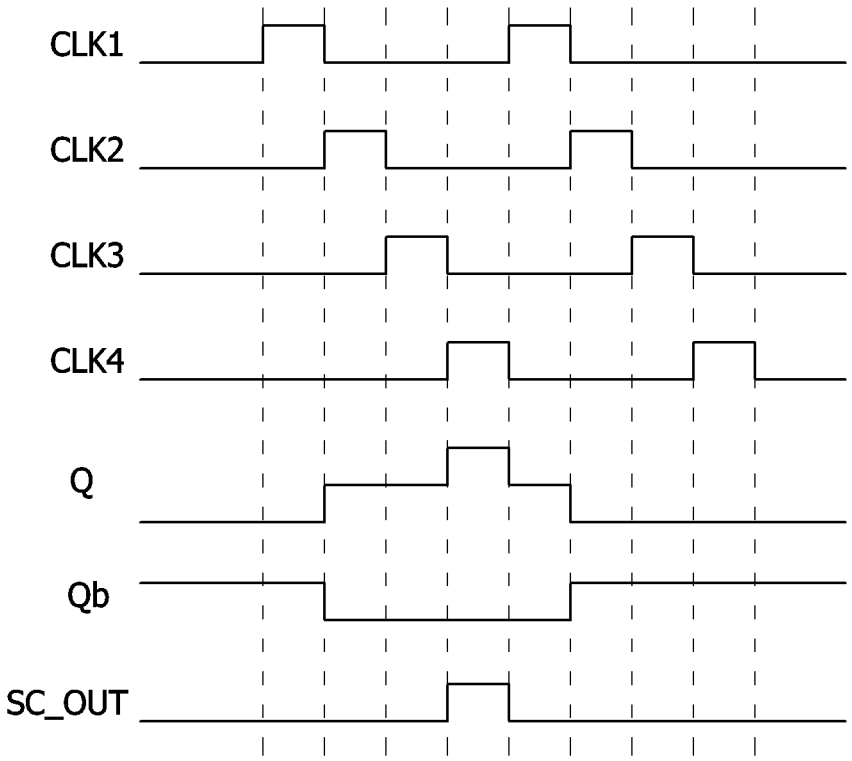
FIG. 9 is a waveform diagram illustrating input/output signals and voltages of control nodes of the gate driver shown in FIG. 8.

FIG. 8 is a view schematically illustrating the gate driver according to the embodiment of the present disclosure, and FIG. 9 is a waveform diagram illustrating input/output signals and voltages of control nodes of the gate driver shown in FIG. 8.

Referring to FIGS. 8 and 9, the gate driver 120 according to the embodiment includes a plurality of signal processing units STG1, STG2, STG3, STG4, and STG5 which are cascade-connected via a carry line through which a carry signal is transmitted.

The timing controller 130 can adjust a width and multi-output of an output signal SC_OUT of the gate driver using a start pulse Vst input to the gate driver 120.

Each of the signal processing units STG1, STG2, STG3, STG4, and STG5 receives a start pulse or a carry signal output from a previous odd-numbered or even-numbered signal processing unit and clock signals CLK1, CLK2, CLK3, and CLK4. A first signal processing unit STG1 starts to be driven according to the start pulse Vst, and the other signal processing units STG2, STG3, STG4, and STG5 receive the carry signal from the previous odd-numbered or even-numbered signal processing unit and start to be driven.

Each of the signal processing units STG1, STG2, STG3, STG4, and STG5 sequentially outputs the scan signals by shifting the start pulse or the carry signal output from the previous odd-numbered or even-numbered signal processing unit according to a timing of the clock signal.

Figure 10:
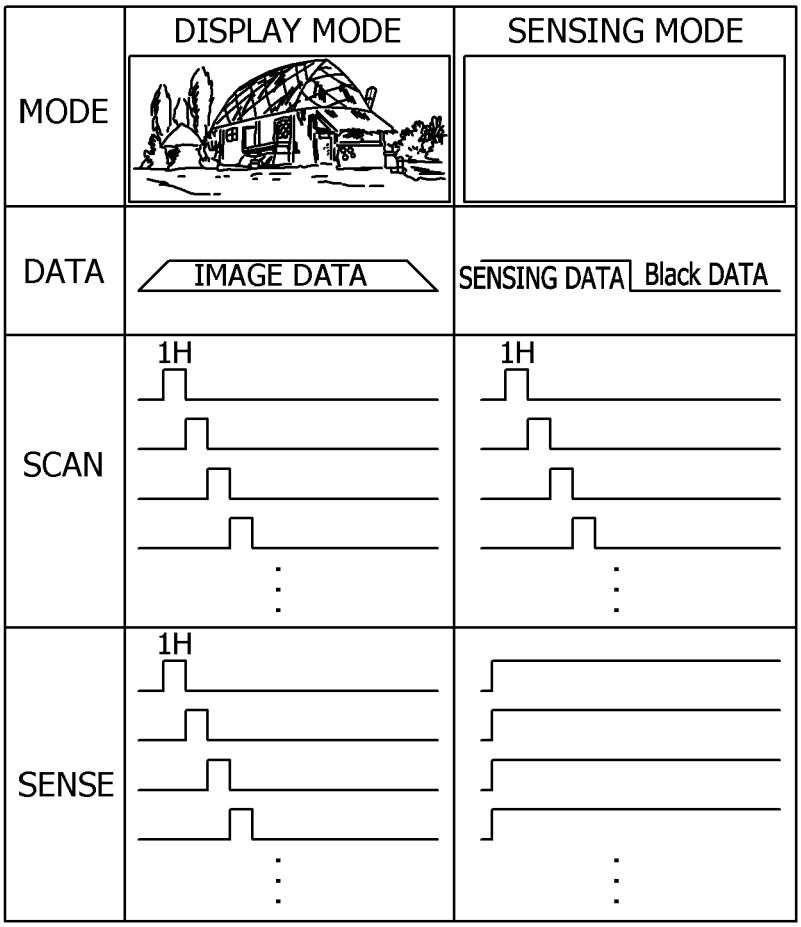
FIG. 10 is a view for describing a driving method according to a mode according to the embodiment of the present disclosure.

FIG. 10 is a view for describing a driving method according to a mode according to the embodiment of the present disclosure.

Referring to FIG. 10, when driving in a display mode, the gate driver sequentially outputs the scan signals and the sensing signals, and the data driver outputs the image data to display an image.

When driving in the sensing mode after the power is turned off, the gate driver outputs the sensing signals as a high-level voltage while sequentially outputting the scan signals, and the data driver outputs white data to a block to be sensed and outputs black data to a block not to be sensed to sense a current without causing the block to be sensed to emit light.

Figure 11:
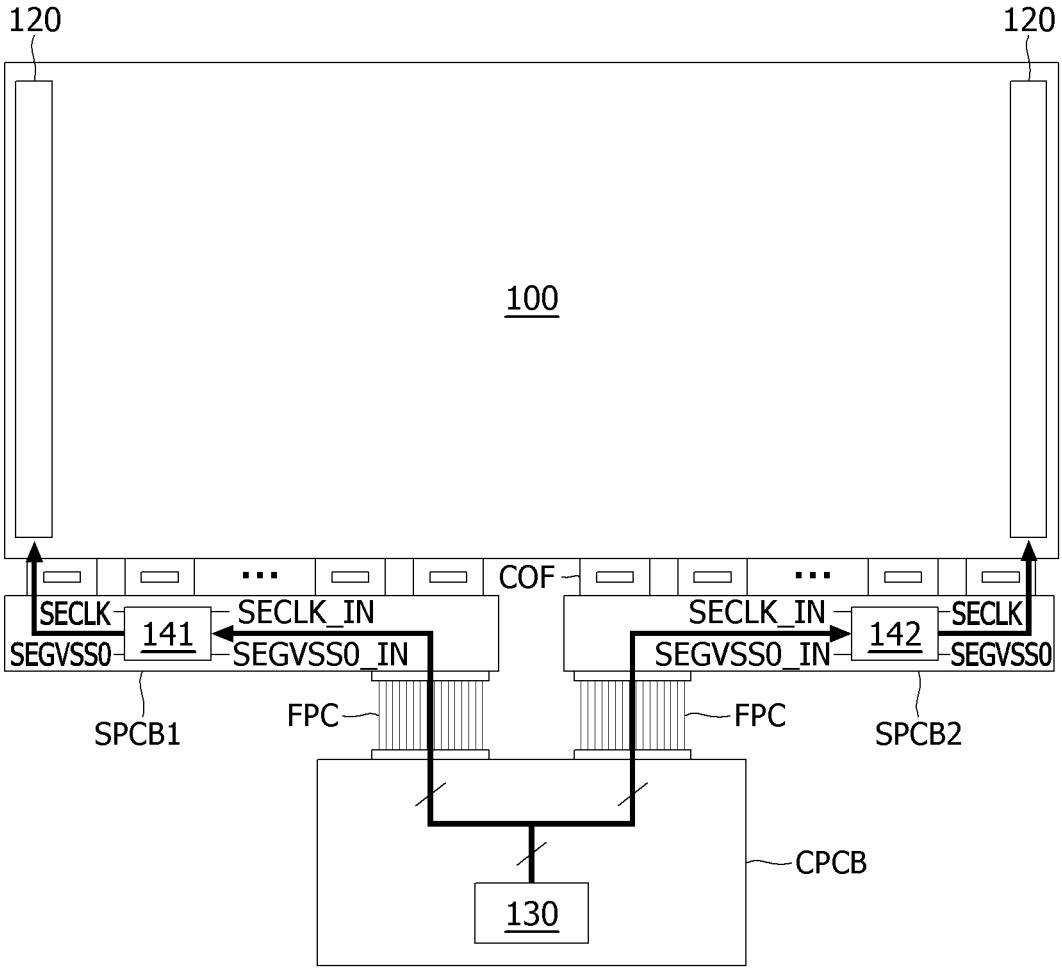
FIG. 11 is a view illustrating input/output signals of a level shifter according to the embodiment.
Figure 12:
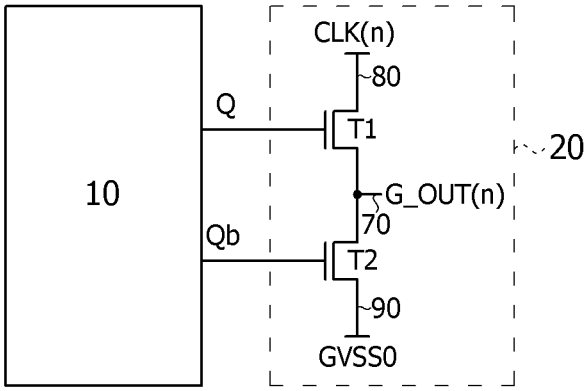
FIG. 12 is a view illustrating a signal transmission unit of the gate driver according to the embodiment.
Figure 13:
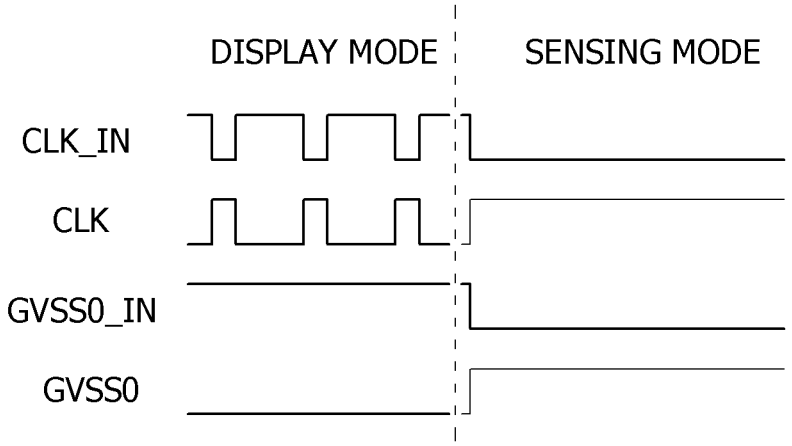
FIG. 13 is a waveform diagram illustrating an input signal of the signal transmission unit shown in FIG. 12.

FIG. 11 is a view illustrating input/output signals of the level shifter according to the embodiment, FIG. 12 is a view illustrating a signal transmission unit of the gate driver according to the embodiment, and FIG. 13 is a waveform diagram illustrating an input signal of the signal transmission unit shown in FIG. 12.

Referring to FIG. 11, the level shifter 140 according to the embodiment can be mounted on each of source printed circuit boards (PCBs) SPCB1 and SPCB2. In this case, the level shifter 140 includes a first level shifter 141 mounted on a first source PCB SPCB1 and a second level shifter 142 mounted on a second source PCB SPCB2. Input terminals of the level shifters 141 and 142 are connected to the timing controller 130 through lines which connect a control board CPCB, an FPC 151, and the source PCBs SPCB1 and SPCB2. Output terminals of the level shifters 141 and 142 can be connected to the gate driver 120 through lines which connect the source PCBs SPCB1 and SPCB2, a chip on film (COF), and the gate driver 120 on the display panel 100.

Although an example in which the level shifter 140 is mounted on the source PCBs SPCB1 and SPCB2 is described here, the present disclosure is not limited thereto, and the level shifter 140 can be mounted on the control board CPCB.

Referring to FIGS. 12 and 13, each signal transmission unit of the gate driver according to the embodiment includes a first circuit unit 10 and a second circuit unit 20. The first circuit unit 10 charges or discharges a first control node (hereinafter referred to as a "Q node") and a second control node (hereinafter referred to as a "Qb node").

In this case, the first circuit unit 10 includes a control circuit which serves to control charging and discharging of the Q node Q and the Qb node Qb and an inverter circuit which inverts a voltage of the Q node Q and applies the voltage to the Qb node Qb. The inverter circuit includes a Qb node charging unit and a Qb node discharging unit.

The second circuit unit 20 outputs gate signals G_OUT(n) in response to potentials of the Q node Q and the Qb node Qb.

The second circuit unit 20 includes first buffer transistors T1 and T2 which output the gate signals G_OUT(n). The first buffer transistors T1 and T2 are classified into a first pull-up transistor T1 that is turned on based on the potential of the Q node Q and a first pull-down transistor T2 that is turned on based on the potential of the Qb node Qb. In the first pull-up transistor T1, a gate electrode is connected to the Q node Q, a first electrode is connected to a clock signal line CLK(n), and a second electrode is connected to a first output terminal 70. In the first pull-down transistor T2, a gate electrode is connected to the Qb node Qb, a first electrode is connected to the output terminal 70, and a second electrode is connected to a low potential voltage line 90. The first buffer transistors T1 and T2 output the gate signals G_OUT (n) based on a clock signal applied through the clock signal line 80 and a low potential voltage applied through the low potential voltage line 90.

In this case, a voltage of the clock signal and the low potential voltage can vary according to a mode of the pixel circuit, for example, the display mode or the sensing mode. For example, while the electrical characteristic of the pixel circuit is sensed, the voltage of the clock signal and the low potential voltage can maintain voltages set as the condition that the switch element of the pixel circuit is turned on.

For example, the clock signal can swing between a high voltage and a low voltage and the low potential voltage can be the low voltage in the display mode in which the pixel circuit emits light according to pixel data, and the voltage of the clock signal can maintain the high voltage and the low potential voltage can be the high voltage in the sensing mode in which the electrical characteristics of the pixel circuit are sensed.

Figure 14:
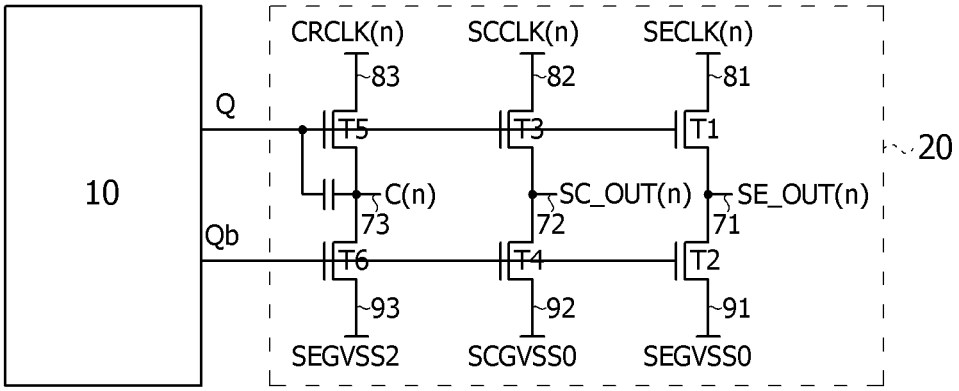
FIG. 14 is a view illustrating a signal transmission unit of a gate driver according to a first embodiment.
Figure 15:
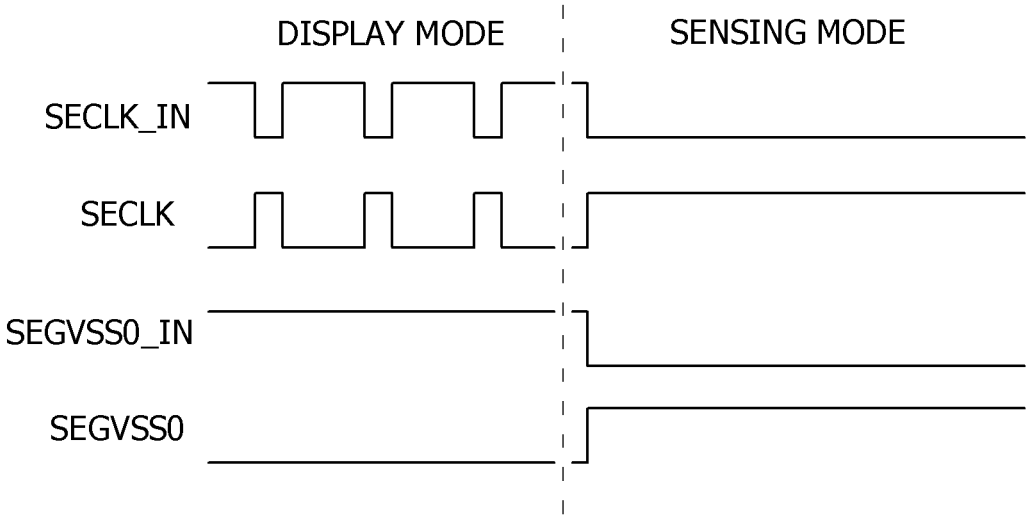
FIG. 15 is a waveform diagram illustrating an input signal of the signal transmission unit shown in FIG. 14.

Referring to FIGS. 14 and 15, each signal transmission unit of a gate driver according to a first embodiment includes a first circuit unit 10 and a second circuit unit 20. The first circuit unit 10 charges or discharges a first control node (hereinafter referred to as a "Q node") and a second control node (hereinafter referred to as a "Qb node").

In this case, the first circuit unit 10 includes a control circuit which serves to control charging and discharging of the Q node Q and the Qb node Qb and an inverter circuit which inverts a voltage of the Q node Q and applies the voltage to the Qb node Qb. The inverter circuit includes a Qb node charging unit and a Qb node discharging unit.

The second circuit unit 20 includes a second-a circuit unit, a second-b circuit unit, and a second-c circuit unit. The second-c circuit unit outputs carry signals C(n) in response to potentials of the Q node Q and the Qb node Qb. The second-b circuit unit outputs scan signals SC_OUT(n) in response to the potentials of the Q node Q and the Qb node Qb. The second-a circuit unit outputs sensing signals SE_OUT(n) in response to the potentials of the Q node Q and the Qb node Qb.

The second-c circuit unit includes third buffer transistors T5 and T6 which output the carry signals C(n). The third buffer transistors T5 and T6 are classified into a third pull-up transistor T5 that is turned on based on the potential of the Q node Q and a third pull-down transistor T6 that is turned on based on the potential of the Qb node Qb. In the third pull-up transistor T5, a gate electrode is connected to the Q node Q and one end of a capacitor C, a first electrode is connected to a first clock signal line 83, and a second electrode is connected to a third output terminal 73 and the other end of the capacitor C. In the third pull-down transistor T6, a gate electrode is connected to the Qb node Qb, a first electrode is connected to the third output terminal 73 and the other end of the capacitor C, and a second electrode is connected to a third low potential voltage line 93. The third buffer transistors T5 and T6 output the carry signals C(n) based on a first clock signal applied through the first clock signal line 83 and a third low potential voltage applied through the third low potential voltage line 93.

The second-b circuit unit includes second buffer transistors T3 and T4 which output the scan signals. The second buffer transistors T3 and T4 are classified into a second pull-up transistor T3 that is turned on based on the potential of the Q node Q and a second pull-down transistor T4 that is turned on based on the potential of the Qb node Qb. In the second pull-up transistor T3, a gate electrode is connected to the Q node Q, a first electrode is connected to a second clock signal line 82, and a second electrode is connected to a second output terminal 72. In the second pull-down transistor T4, a gate electrode is connected to the Qb node Qb, a first electrode is connected to the second output terminal 72, and a second electrode is connected to a second low potential voltage line 92. The second buffer transistors T3 and T4 outputs the scan signals based on a second clock signal applied through the second clock signal line 82 and a second low potential voltage applied through the second low potential voltage line 92.

The second-a circuit unit includes first buffer transistors T1 and T2 which output sensing signals SE_OUT(n). The first buffer transistors T1 and T2 are classified into a first pull-up transistor T1 that is turned on based on the potential of the Q node Q and a first pull-down transistor T2 that is turned on based on the potential of the Qb node Qb. In the first pull-up transistor T1, a gate electrode is connected to the Q node Q, a first electrode is connected to a third clock signal line 81, and a second electrode is connected to a first output terminal 71. In the first pull-down transistor T2, a gate electrode is connected to the Qb node Qb, a first electrode is connected to the first output terminal 71, and a second electrode is connected to a first low potential voltage line 91. The first buffer transistors T1 and T2 output the sensing signals SE_OUT(n) based on a third clock signal applied through the third clock signal line 81 and a first low potential voltage applied through the first low potential voltage line 91.

In this case, since the second-b circuit unit and the second-a circuit unit share the Q node and the Qb node when outputting the scan signals SC_OUT(n) and the sensing signals SE_OUT(n), the third clock signal line 81 and the first low potential voltage line 91 are set to always output a high level voltage. Accordingly, the sensing signals SE_OUT(n) always become a high level voltage during sensing driving.

Figure 16:
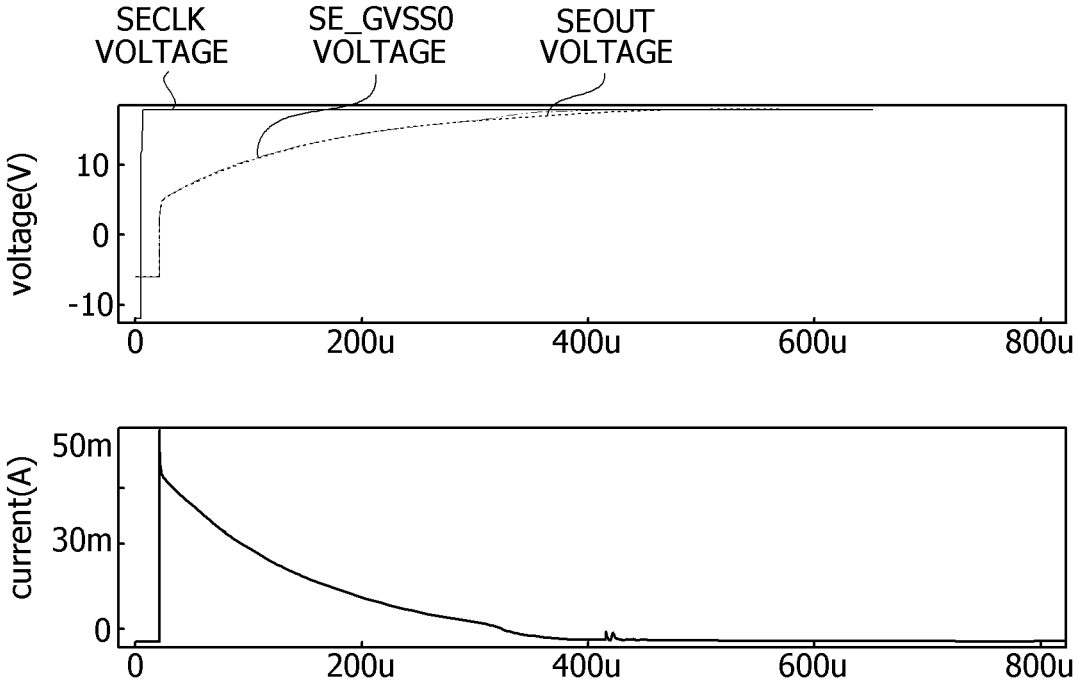
FIG. 16 is a view illustrating a simulation result of the gate driver shown in FIG. 14.

FIG. 16 is a view illustrating a simulation result of the gate driver shown in FIG. 14.

Referring to FIG. 16, when the third clock signal line 81 and the first low potential voltage line 91 are always at a high level voltage, it can be seen that the sensing signals become the high level voltage after a predetermined time (for example, 200 μs). For example, when driving in the sensing mode after the power is turned off, the sensing signals of the high level voltage are output normally.

Further, it can be seen that an effective value i_rms of a current flowing through the first low potential voltage line 91 is 18 mA. The effective value i_rms of the current has little power loss generated in the pixel circuit and thus has no problem being used when measured to be 30 mA or less.

Figure 17:
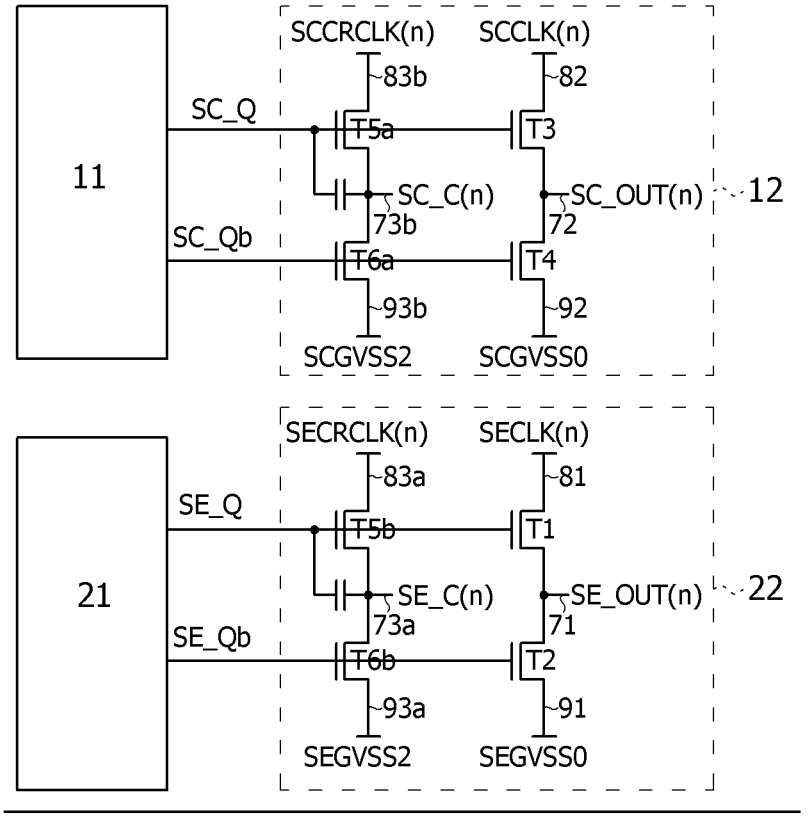
FIG. 17 is a view illustrating a signal transmission unit of a gate driver according to a second embodiment.
Figure 18:
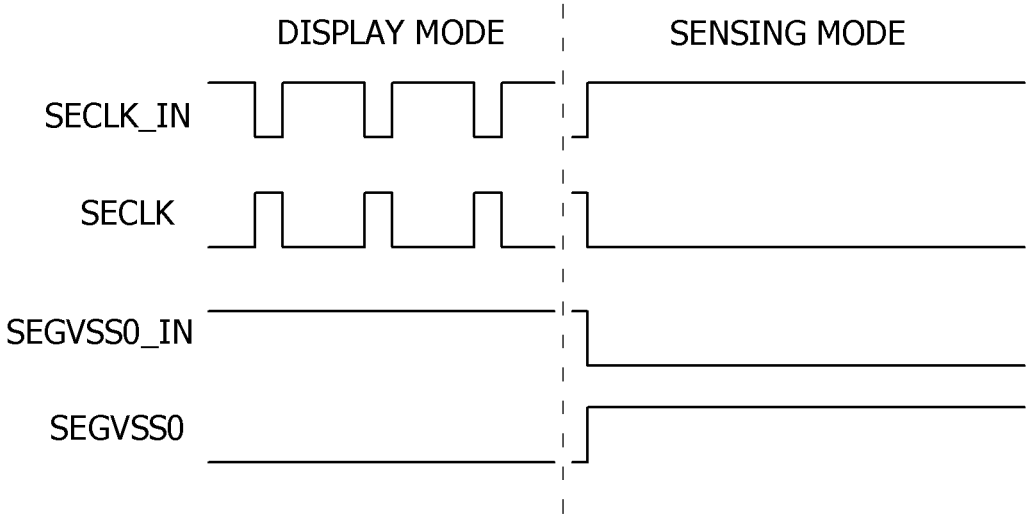
FIG. 18 is a waveform diagram illustrating an input signal of the signal transmission unit shown in FIG. 17.

FIG. 17 is a view illustrating a signal transmission unit of a gate driver according to a second embodiment, and FIG. 18 is a waveform diagram illustrating an input signal of the signal transmission unit shown in FIG. 17.

Referring to FIGS. 17 and 18, each signal transmission unit of the gate driver according to the second embodiment includes a first circuit unit 10 and a second circuit unit 20. The first circuit unit 10 includes a first-a circuit unit 21 and a first-b circuit unit 11. The first-a circuit unit 21 charges or discharges a first-a control node (hereinafter referred to as an "SE_Q node") and a second-a control node (hereinafter referred to as an "SE_Qb node"). The first-b circuit unit 11 charges or discharges a first-b control node (hereinafter referred to as an "SC_Q node") and a second-b control node (hereinafter referred to as an "SC_Qb node").

The second circuit unit 20 includes a second-a circuit unit 22 and a second-b circuit unit 12. The second-b circuit unit 12 includes a second-b1 circuit unit and a second-b2 circuit unit. The second-b1 circuit unit outputs first-b carry signals SC_C(n) in response to potentials of a first-b Q node SC_Q and a second-b Qb node SC_Qb. The second-b2 circuit unit outputs scan signals SC_OUT(n) in response to the potentials of the first-b Q node SC_Q and the second-b Qb node SC_Qb.

The second-b1 circuit unit includes third-b buffer transistors T5*b* and T6*b* which output the first-b carry signals SC_C(n). The third-b buffer transistors T5*b* and T6*b* are classified into a third-b pull-up transistor T5*b* that is turned on based on the potential of the first-b Q node SC_Q and a third-b pull-down transistor T6*b* that is turned on based on the potential of the second-b Qb node SC_Qb. In the third-b pull-up transistor T5*b*, a gate electrode is connected to the first-b Q node SC_Q and one end of a capacitor C, a first electrode is connected to a third-b clock signal line 83*b*, and a second electrode is connected to a first-b output terminal 73*b* and the other end of the capacitor C. In the third-b pull-down transistor T6*b*, a gate electrode is connected to the second-b Qb node SC_Qb, a first electrode is connected to the first-b output terminal 73*b* and the other end of the capacitor C, and a second electrode is connected to a second-b low potential voltage line 93*b*. The third-b buffer transistors T5*b* and T6*b* output the first-b carry signals SC_C(n) based on a third-b clock signal applied through the third-b clock signal line 83*b* and a second-b low potential voltage applied through the second-b low potential voltage line 93*b*.

The second-b2 circuit unit includes second buffer transistors T3 and T4 which output the scan signals SC_OUT(n). The second buffer transistors T3 and T4 are classified into a second pull-up transistor T3 that is turned on based on the potential of the first-b Q node SC_Q and a second pull-down transistor T4 that is turned on based on the potential of the second-b Qb node SC_Qb. In the second pull-up transistor T3, a gate electrode is connected to the first-b Q node SC_Q, a first electrode is connected to a second clock signal line 82, and a second electrode is connected to a second output terminal 72. In the second pull-down transistor T4, a gate electrode is connected to the second-b Qb node SC_Qb, a first electrode is connected to the second output terminal 72, and a second electrode is connected to a first-b low potential voltage line 92. The second buffer transistors T3 and T4 output the scan signals SC_OUT(n) based on a second clock signal applied through the second clock signal line 82 and a first-b low potential voltage applied through the first-b low potential voltage line 92.

The second-a circuit unit 22 includes a second-a1 circuit unit and a second-a2 circuit unit. The second-a2 circuit unit outputs first-a carry signals SE_C(n) in response to potentials of a first-a Q node SE_Q and a second-a Qb node SE_Qb. The second-a1 circuit unit outputs sensing signals SE_OUT(n) in response to potentials of a first-b Q node SE_Q and a second-b Qb node SE_Qb.

The second-a2 circuit unit includes third-a buffer transistors T5*b* and T6*b* which output the first-a carry signals SE_C(n). The third-a buffer transistors T5*b* and T6*b* are classified into a third-a pull-up transistor T5*b* that is turned on based on the potential of the first-a Q node SE_Q and a third-a pull-down transistor T6*b* that is turned on based on the potential of the second-a Qb node SE_Qb. In the third-a pull-up transistor T5*b*, a gate electrode is connected to the first-a Q node SE_Q and one end of a capacitor C, a first electrode is connected to a third-a clock signal line 83*a*, and a second electrode is connected to a third-a output terminal 73*b* and the other end of the capacitor C. In the third-a pull-down transistor T6*b*, a gate electrode is connected to the second-a Qb node SE_Qb, a first electrode is connected to the third-a output terminal 73*b* and the other end of the capacitor C, and a second electrode is connected to a second-a low potential voltage line 93*a*. The third-a buffer transistors T5*b* and T6*b* output the first-a carry signals SE_C(n) based on a third-a clock signal applied through the third-a clock signal line 83*a* and a second-a low potential voltage applied through the second-a low potential voltage line 93*a*.

The second-a1 circuit unit includes first buffer transistors T1 and T2 which output sensing signals SE_OUT(n). The first buffer transistors T1 and T2 are classified into a first pull-up transistor T1 that is turned on based on the potential of the first-a Q node SE_Q and a first pull-down transistor T2 that is turned on based on the potential of the second-a Qb node SE_Qb. In the first pull-up transistor T1, a gate electrode is connected to the first-a Q node SE_Q, a first electrode is connected to a first clock signal line 81, and a second electrode is connected to a first output terminal 71. In the first pull-down transistor T2, a gate electrode is connected to the second-a Qb node SE_Qb, a first electrode is connected to the first output terminal 71, and a second electrode is connected to a first-a low potential voltage line 91. The first buffer transistors T1 and T2 output the sensing signals SE_OUT(n) based on a first clock signal applied through the first clock signal line 81 and a first low potential voltage applied through the first low potential voltage line 91.

In this case, since the second-a1 circuit unit is in a state in which the second-a Qb node maintains a high level voltage after the power is turned off, the first low potential voltage line 91 is set to always maintain a high level voltage. On the other hand, the first clock signal line 81 can be any one of a high level voltage, a low level voltage, and a clock signal. In an aspect of power consumption, the first clock signal line 81 can have a low level voltage. Accordingly, the sensing signal SE_OUT(n) always becomes a high level voltage regardless of the first clock signal line 81 during the sensing driving.

Figure 19:
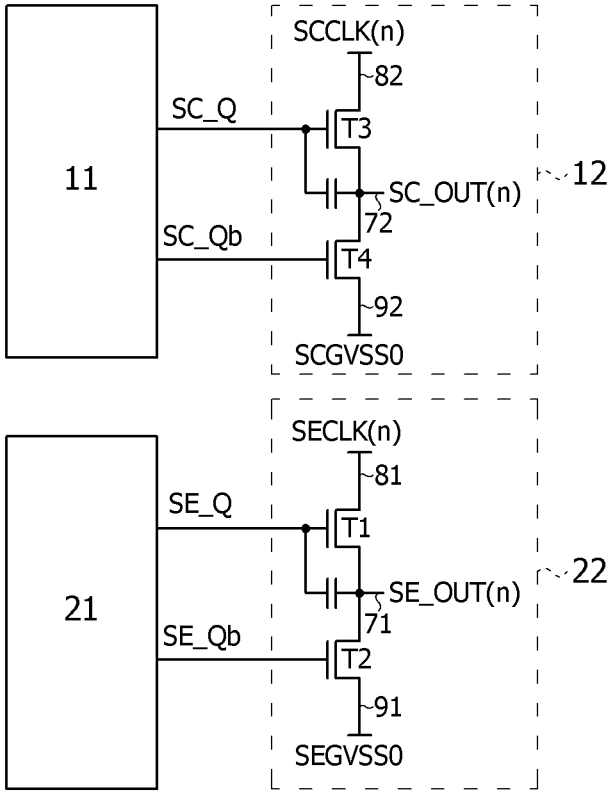
FIG. 19 is a view illustrating a signal transmission unit of a gate driver according to a third embodiment.
Figure 20:
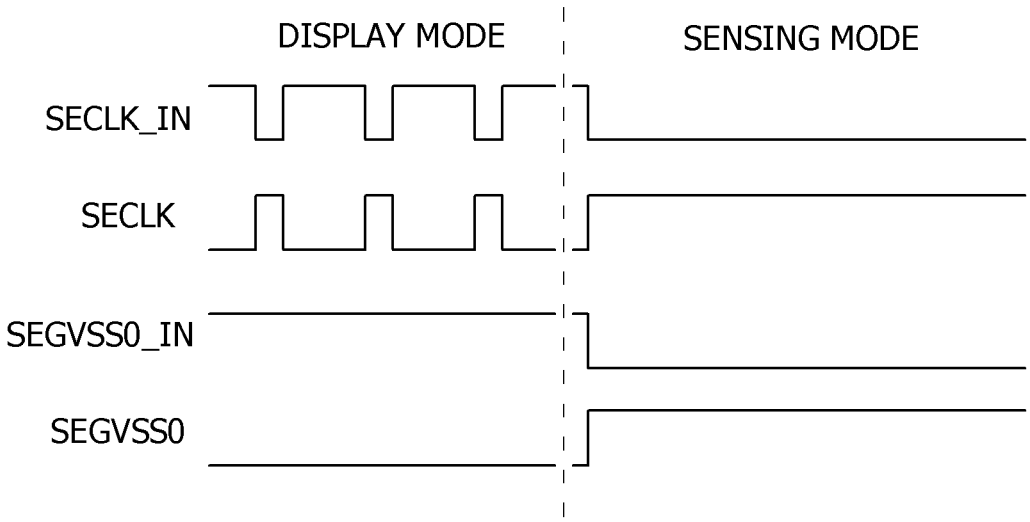
FIG. 20 is a waveform diagram illustrating an input signal of the signal transmission unit shown in FIG. 19.

FIG. 19 is a view illustrating a signal transmission unit of a gate driver according to a third embodiment, and FIG. 20 is a waveform diagram illustrating an input signal of the signal transmission unit shown in FIG. 19.

Referring to FIGS. 19 and 20, the gate driver according to the third embodiment includes a first circuit unit 10 and a second circuit unit 20. The first circuit unit 10 includes a first-a circuit unit 21 and a first-b circuit unit 11. The first-a circuit unit 21 charges or discharges a first-a control node (hereinafter referred to as an "SE_Q node") and a second-a control node (hereinafter referred to as an "SE_Qb node"). The first-b circuit unit 11 charges or discharges a first-b control node (hereinafter referred to as an "SC_Q node") and a second-b control node (hereinafter referred to as an "SC_Qb node").

The second circuit unit 20 includes a second-a circuit unit 22 and a second-b circuit unit 12. The second-b circuit unit 12 outputs scan signals SC_OUT(n) in response to potentials of a first-b Q node SC_Q and a second-b Qb node SC_Qb. These scan signals SC_OUT(n) are also used as first-b carry signals. The second-a circuit unit 22 outputs sensing signals SE_OUT(n) in response to potentials of a first-a Q node SE_Q and a second-a Qb node SE_Qb. These sensing signals SE_OUT(n) are also used as first-a carry signals.

The second-b circuit unit 12 includes second buffer transistors T3 and T4 which output the scan signals SC_OUT(n). The second buffer transistors T3 and T4 are classified into a second pull-up transistor T3 that is turned on based on the potential of the first-b Q node SC_Q and a second pull-down transistor T4 that is turned on based on the potential of the second-b Qb node SC_Qb. In the second pull-up transistor T3, a gate electrode is connected to the first-b Q node SC_Q, a first electrode is connected to a second clock signal line 82, and a second electrode is connected to a second output terminal 72. In the second pull-down transistor T4, a gate electrode is connected to the second-b Qb node SC_Qb, a first electrode is connected to the second output terminal 72, and a second electrode is connected to a first-b low potential voltage line 92. The second buffer transistors T3 and T4 output the scan signals SC_OUT(n) based on a second clock signal applied through the second clock signal line 82 and a first-b low potential voltage applied through the first-b low potential voltage line 92.

The second-a circuit unit 22 includes first buffer transistors T1 and T2 which output sensing signals SE_OUT(n). The first buffer transistors T1 and T2 are classified into a first pull-up transistor T1 that is turned on based on the potential of the first-a Q node SE_Q and a first pull-down transistor T2 that is turned on based on the potential of the second-a Qb node SE_Qb. In the first pull-up transistor T1, a gate electrode is connected to the first-a Q node SE_Q, a first electrode is connected to a first clock signal line 81, and a second electrode is connected to a first output terminal 71.

In the first pull-down transistor T2, a gate electrode is connected to the second-a Qb node SE_Qb, a first electrode is connected to the first output terminal 71, and a second electrode is connected to a first-a low potential voltage line 91. The first buffer transistors T1 and T2 output the sensing signals SE_OUT(n) based on a first clock signal applied through the first clock signal line 81 and a first-a low potential voltage applied through the first-a low potential voltage line 91.

In this case, since the carry signal and the sensing signal are integrated and thus the first clock signal is used as the first carry signal when the second-a circuit unit outputs the sensing signal SE_OUT(n), the first clock signal line 81 and the first-a low potential voltage line 91 are set to always output a high level voltage. Accordingly, the sensing signal SE_OUT(n) always becomes a high level voltage during the sensing driving.

Figure 21:
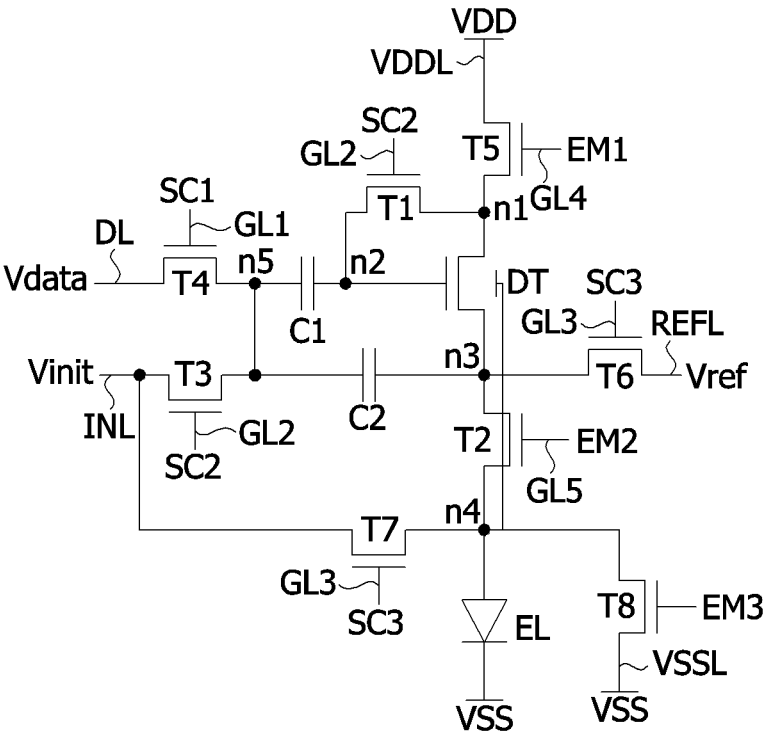
FIG. 21 is a circuit diagram illustrating a pixel circuit according to another embodiment of the present disclosure.
Figure 22:
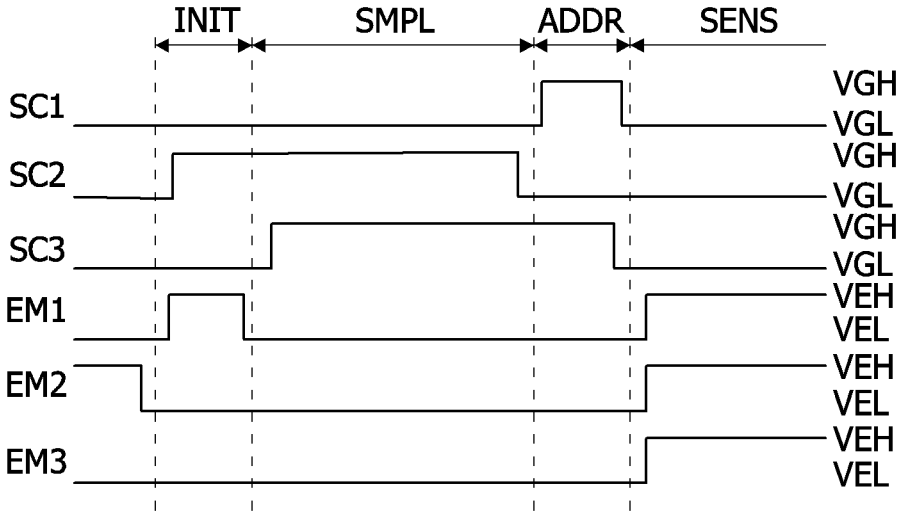
FIG. 22 is a waveform diagram illustrating a driving method of the pixel circuit shown in FIG. 21.

FIG. 21 is a circuit diagram illustrating a pixel circuit according to another embodiment of the present disclosure. The pixel circuit shown in FIG. 21 includes an internal compensation circuit which compensates for a threshold voltage change of a driving element DT by sampling a threshold voltage of the driving element DT. FIG. 22 is a waveform diagram illustrating a driving method of the pixel circuit shown in FIG. 21.

Referring to FIGS. 21 and 22, the pixel circuit includes a light-emitting element EL, a driving element DT, first and second capacitors C1 and C2, and first to eighth switch elements T1 to T8. The driving element DT and the switch elements T1 to T8 can be implemented as n-channel oxide TFTs.

Direct current voltages such as a pixel driving voltage VDD, a low potential power voltage VSS, a reference voltage Vref, and an initialization voltage Vinit, a data voltage Vdata which varies according to a gray level of the pixel data, scan pulses SC1, SC2, and SC3, and EM pulses EM1 and EM2 are supplied to the pixel circuit. Voltages of the scan pulses SC1, SC2, and SC3 and voltages of the EM pulses EM1 and EM2 swing between gate-on voltages VGH and VEH and gate-off voltages VGL and VEL.

A relationship of the voltages commonly applied to the pixels can be set as VDD>Vref>Vinit>VSS. The data voltage Vdata can be generated as a gamma compensation voltage selected according to the gray level of the pixel data from the data driver 110 in a voltage range lower than the pixel driving voltage VDD and greater than the low potential power voltage VSS. The initialization voltage Vinit can be set as a voltage lower than or equal to the threshold voltage of the light-emitting element EL. The reference voltage Vref can be set as a voltage greater than the initialization voltage Vinit so that a negative back-bias is applied to the driving element DT in a sampling operation SMPL. The gate-on voltages VGH and VEH can be set to be greater than the pixel driving voltage VDD. The gate-off voltages VGL and VEL can be set to be lower than the low potential power voltage VSS.

The scan pulses SC1, SC2, and SC3 can include a first scan pulse SC1 applied to a first gate line GL1, a second scan pulse SC2 applied to a second gate line GL2, and a third scan pulse SC3 applied to a third gate line GL3. The EM pulses EM1 and EM2 can include a first EM pulse EM1 applied to a fourth gate line GL4 and a second EM pulse EM2 applied to a fifth gate line GL5.

A driving period of the pixel circuit can be divided into an initialization operation INIT in which the pixel circuit is initialized, a sampling operation SMPL of sampling a threshold voltage Vth of the driving element DT, an addressing operation ADDR in which the data voltage Vdata is charged and the pixel data is written, and a sensing operation SENS of sensing an electrical characteristic of the pixel circuit, for example, a current flowing through a pixel power line.

The first scan pulse SC1 can be the gate-on voltage VGH in the addressing operation ADDR. The first scan pulse SC1 can be the gate-off voltage VGL in the initialization operation INIT, the sampling operation SMPL, and the sensing operation SENS. The first scan pulse SC1 can be generated as a pulse smaller than or equal to one horizontal period 1H synchronized with the data voltage Vdata of the pixel data. The data voltage Vdata is supplied to the pixel circuit through the data line DL in the addressing operation ADDR in synchronization with the first scan pulse SC1.

The second scan pulse SC2 can rise to the gate-on voltage VGH before the third scan pulse SC3, and can fall to the gate-off voltage VGL before a falling edge of the third scan pulse SC3. The second scan pulse SC2 can be the gate-on voltage VGH in the initialization operation INIT and the sampling operation SMPL. The second scan pulse SC2 can be the gate-off voltage VGL in the addressing operation ADDR and the sensing operation SENS.

The third scan pulse SC3 can be generated as the gate-on voltage VGH in the sampling operation SMPL and the addressing operation ADDR. In the addressing operation ADDR, a gate-on voltage section of the third scan pulse SC3 can overlap a gate-on voltage section of the first scan pulse SC1. The third scan pulse SC3 can rise to the gate-on voltage VGH after a rising edge of the second scan pulse SC2, and then can fall to the gate-off voltage after a falling edge of the second scan pulse SC2 VGL. The third scan pulse SC3 can be the gate-off voltage VGL in the initialization operation INIT and the sensing operation SENS.

The first EM pulse EM1 can be generated as the gate-on voltage VGH in the initialization operation INIT and can be generated as the gate-on voltage VEH in at least a partial section of the sensing operation SENS. The first EM pulse EM1 can be the gate-off voltage VEL in the sampling operation INIT and the addressing operation ADDR. The first EM pulse EM1 can fall to the gate-off voltage VEL after a falling edge of the second EM pulse EM2, and can rise to the gate-on voltage VEH before a rising edge of the second EM pulse EM2.

The second EM pulse EM2 can be generated as the gate-on voltage VEH in at least the partial section of the sensing operation SENS. The second EM pulse EM2 can be the gate-off voltage VEL in the initialization operation INIT, the sampling operation INIT, and the addressing operation ADDR.

A third EM pulse EM3 can be generated as the gate-on voltage VEH in at least the partial section of the sensing operation SENS. The third EM pulse EM3 can be the gate-off voltage VEL in the initialization operation INIT, the sampling operation INIT, and the addressing operation ADDR.

The light-emitting element EL can be implemented as an organic light-emitting diode (OLED). An anode of the light-emitting element EL can be connected to a fourth node n4, and a low potential power voltage VSS can be applied to a cathode of the light-emitting element EL.

The first capacitor C1 can be connected between a second node n2 and a fifth node n5. The first capacitor C1 stores the threshold voltage Vth of the driving element DT in the sampling operation SMPL. In the addressing operation ADDR, the data voltage Vdata is transmitted to a first gate electrode of the driving element DT through the first capacitor C1.

The second capacitor C2 is connected between a third node n3 and the fifth node n5. The second capacitor C2 stores a second electrode voltage of the driving element DT, for example, a source voltage at the beginning of the sensing operation SENS, and maintains a gate-source voltage Vgs of the driving elements in the sensing operation SENS.

The driving element DT can be a metal-oxide semiconductor field-effect-transistor (MOSFET) having a double gate structure. The driving element DT includes a first gate electrode connected to the second node n2, a second gate electrode connected to the fourth node n4, a first electrode connected to the first node n1, and a second electrode connected to the third node n3. The first gate electrode and the second gate electrode of the driving element DT can overlap each other with a semiconductor active pattern ACT therebetween.

The first switch element T1 includes a first electrode connected to the first node n1, a second electrode connected to the second node n2, and a gate electrode to which the second scan pulse SC2 is applied. The first switch element T1 is turned on in the initialization operation INIT and the sampling operation SMPL in response to the gate-on voltage VGH of the second scan pulse SC2 to connect the first node n1 and the second node n2. When the first switch element T1 is turned on, the driving element DT operates as a diode as the first gate electrode and the first electrode are connected.

The second switch element T2 includes a first electrode connected to the third node n3, a second electrode connected to the fourth node n4, and a gate electrode to which the second EM pulse EM2 is applied. The second switch element T2 is turned on in at least a partial section of the sensing operation SENS in response to the gate-on voltage VEH of the second EM pulse EM2 to form a current path between the driving element DT and the light-emitting element EL. In the initialization operation INIT, the sampling operation SMPL, and the addressing operation ADDR in which the second switch element T2 is in an off state, since the current path between the driving element DT and the light-emitting element EL is cut off, the light-emitting element EL does not emit light.

The third switch element T3 includes a first electrode connected to a second power line INL to which the initialization voltage Vinit is applied, a second electrode connected to the fifth node n5, and a gate electrode to which the second scan pulse SC2 is applied. The third switch element T3 is turned on in the initialization operation INIT and the sampling operation SMPL in response to the gate-on voltage VGH of the second scan pulse SC2 to supply the initialization voltage Vinit to the fifth node n5. In the addressing operation ADDR and the sensing operation SENS in which the third switch element T3 is turned off, a current path between the second power line INL and the fifth node n5 is cut off.

The fourth switch element T4 includes a first electrode connected to the data line DL to which the data voltage Vdata is applied, a second electrode connected to the fifth node n5, and a gate electrode to which the first scan pulse SC1 is applied. The fourth switch element T4 is turned on in the addressing operation ADDR in response to the gate-on voltage VGH of the first scan pulse SC1 to supply the data voltage Vdata to the fifth node n5. During the initialization operation INIT, the sampling operation SMPL, and the sensing operation SENS in which the fourth switch element T4 is turned off, a current path between the data line DL and the fifth node n5 is cut off.

The fifth switch element T5 includes a first electrode connected to the first power line VDDL to which the pixel driving voltage VDD is applied, a second electrode connected to the first node n1, and a gate electrode to which the first EM pulse EM1 is applied. The fifth switch element T5 is turned on in the initialization operation INIT and the sensing operation SENS in response to the gate-on voltage VEH of the first EM pulse EM1 to supply the pixel driving voltage VDD to the node n1. In the sampling operation SMPL and the addressing operation ADDR in which the fifth switch element T5 is turned off, a current path between the first power line VDDL and the first node n1 is cut off.

The sixth switch element T6 includes a first electrode connected to the third node n3, a second electrode connected to a third power line REFL to which the reference voltage Vref is applied, and a gate electrode to which the third scan pulse SC3 is applied. The sixth switch element T6 is turned on in the sampling operation SMPL and the addressing operation ADDR in response to the gate-on voltage VGH of the third scan pulse SC3 to supply the reference voltage Vref to the third node n3. In the initialization operation INIT and the sensing operation SENS in which the sixth switch element T6 is turned off, a current path between the third power line REFL and the third node n3 is cut off.

The seventh switch element T7 includes a first electrode connected to the second power line INL to which the initialization voltage Vinit is applied, a second electrode connected to the fourth node n4, and a gate electrode to which the third scan pulse SC3 is applied. The seventh switch element T7 is turned on in the sampling operation SMPL and the addressing operation ADDR in response to the gate-on voltage VGH of the third scan pulse SC3 to supply the initialization voltage Vinit to the fourth node n4. When the seventh switch element T7 is turned on, the reference voltage Vref is applied to the third node n3 through the sixth switch element T6. In the initialization operation INIT and the sensing operation SENS in which the seventh switch element T7 is turned off, a current path between the second power line INL and the fourth node n4 is cut off.

The eighth switch element T8 includes a first electrode connected to the fourth node n4, a second electrode connected to a fourth power line VSSL to which the low potential power voltage VSS is applied, and a gate electrode to which the third EM pulse EM3 is applied. The eighth switch element T8 is turned on in the sensing operation SENS in response to the gate-on voltage VEH of the third EM pulse EM3 to form a current path between the fourth node n4 and the fourth power line VSSL.

In the present disclosure, since the threshold voltage Vth of the driving element DT is sampled by applying the reference voltage Vref to the third node n3 in the sampling operation SMPL, and the data voltage Vdata is applied to the fifth node n5 in the addressing operation ADDR, the sampling operation SMPL and the addressing operation ADDR can be separated. As a result, according to the present disclosure, a shift of the threshold voltage Vth' can be compensated for by securing a sufficiently long time of the sampling operation SMPL, for example, two or more horizontal periods, to accurately sense the threshold voltage Vth' of the driving element DT.

Hereinafter, a driving method for operation of the pixel circuit will be described in detail with reference to FIGS. 23 to 26.

Figure 23:
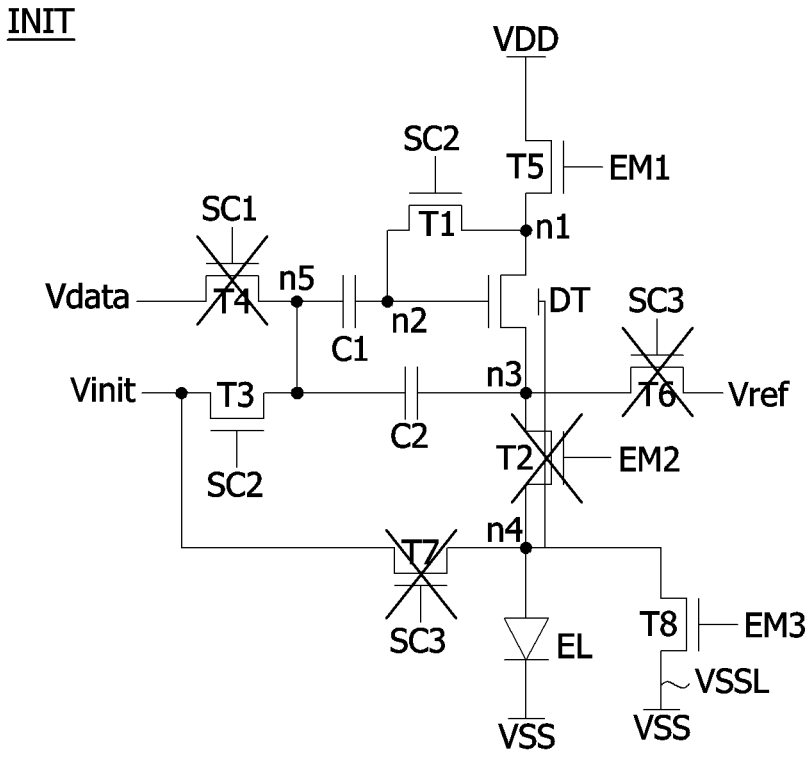
FIG. 23 is a circuit diagram illustrating an initialization operation of the pixel circuit shown in FIG. 21.

FIG. 23 is a circuit diagram illustrating the initialization operation INIT of the pixel circuit shown in FIG. 21.

Referring to FIG. 23, in the initialization operation INIT, the second scan pulse SC2 and the first EM pulse EM1 are generated as the gate-on voltages VGH and VEH, and other gate signals SC1, SC3, and EM2 are the gate-off voltages VGL and VEL. In the initialization operation INIT, the second, fourth, sixth, and seventh switch elements T2, T4, T6, and T7 are turned off. Accordingly, in the initialization operation INIT, the first, third, and fifth switch elements T1, T3, and T5 and the driving element DT are turned on. In this case, the first gate electrode and the first electrode of the driving element DT are connected by a diode connection.

In the initialization operation INIT, voltages of the first and second nodes n1 and n2 are initialized to the pixel driving voltage VDD, and a voltage of the third node n3 changes to VDD—Vth0. Here, Vth0 is an initial threshold voltage in which Vbs is not applied to the driving element DT. A voltage of the fifth node n5 is the initialization voltage Vinit. A voltage of the fourth node n4 is maintained as the initialization voltage Vinit applied to a previous frame.

Figure 24:
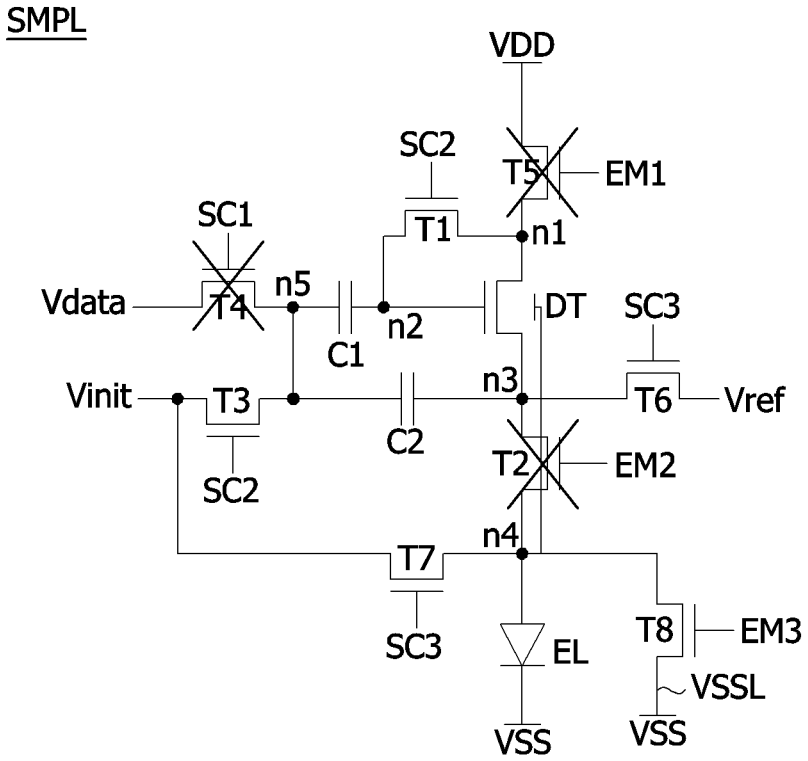
FIG. 24 is a circuit diagram illustrating a sampling operation of the pixel circuit shown in FIG. 21.

FIG. 24 is a circuit diagram illustrating the initialization operation SMPL of the pixel circuit shown in FIG. 21.

Referring to FIG. 24, in the sampling operation SMPL, the third scan pulse SC3 is inverted to the gate-on voltage VGH, and the first EM pulse EM1 is inverted to the gate-off voltage VEL. The second scan pulse SC2 maintains the gate-on voltage VGH in the sampling operation SMPL. In the sampling operation SMPL, the second and third scan pulses SC2 and SC3 are the gate-on voltages VGH, and other gate signals SC1, EM1, and EM2 are the gate-off voltages VGL and VEL. Accordingly, in the sampling operation SMPL, the first, third, sixth, and seventh switch elements T1, T3, T6, and T7 and the driving element DT are turned on.

In the sampling operation SMPL, the initialization voltage Vinit is applied to the second gate electrode G2 of the driving element DT through the seventh switch element T7 which is turned on, and the reference voltage Vref greater than the initialization voltage Vinit is applied to the second electrode of the driving element DT through the sixth switch element T6 which is turned on. Accordingly, since the Vbs can be applied to the driving element, the threshold voltage of the driving element DT can be shifted to a positive voltage greater than zero.

In the sampling operation SMPL, the voltages of the first and second nodes n1 and n2 are changed to Vref+Vth0+$\alpha$. Here, $\alpha$ is equal to $\beta$(Vref−Vinit), and $\beta$ is equal to Cbuf/Cgi. The voltage of the third node n3 is the reference voltage Vref, and the voltages of the fourth and fifth nodes n4 and n5 are maintained as the initialization voltage Vinit.

Figure 25:
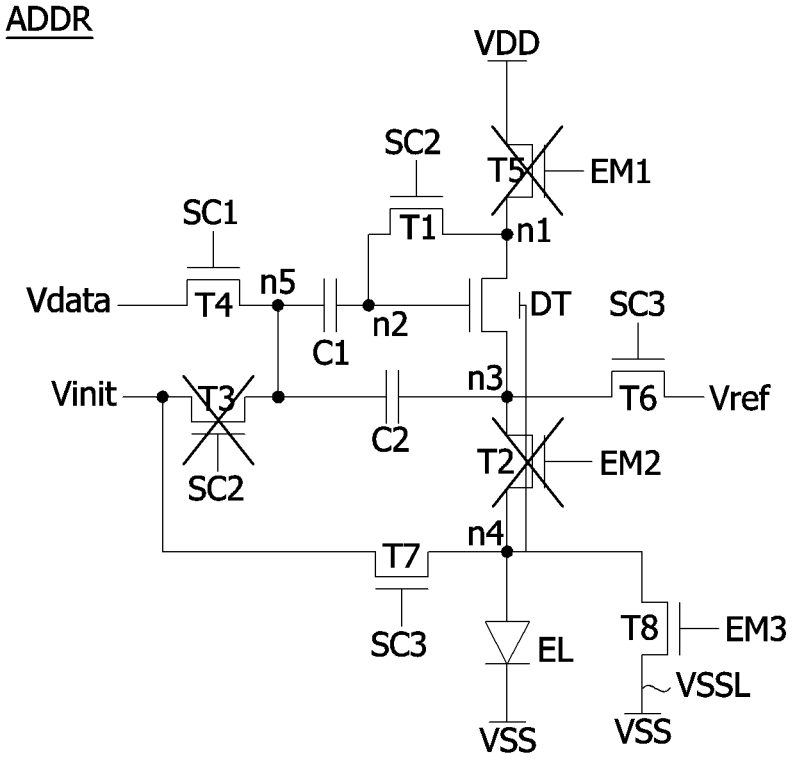
FIG. 25 is a circuit diagram illustrating an addressing operation of the pixel circuit shown in FIG. 21.

FIG. 25 is a circuit diagram illustrating the addressing operation ADDR of the pixel circuit shown in FIG. 21.

Referring to FIG. 25, in the addressing operation ADDR, the first scan pulse SC1 synchronized with the data voltage Vdata of the pixel data is generated as the gate-on voltage VGH. In the addressing operation ADDR, the third scan pulse SC3 is maintained as the gate-on voltage VGH, and then is inverted to the gate-off voltage VGL. In the addressing operation ADDR, the first EM pulse EM1 is maintained as the gate-off voltage VEL, and then is inverted to the gate-on voltage after a falling edge of the first scan pulse SC1. The second scan pulse SC2 is inverted to the gate-off voltage VGL in the addressing operation ADDR. In the addressing operation ADDR, voltages of the first and second EM pulses EM1 and EM2 can be the gate-off voltage VEL. Accordingly, in the addressing operation ADDR, the fourth, sixth, and seventh switch elements T4, T6, and T7 and the driving element DT are turned on.

In the addressing operation ADDR, the voltage of the first node n1 is maintained as Vref+Vth0+$\alpha$, and the voltage of the second node n2 changes to Vref+Vth0+$\alpha$+C' (Vdata−Vinit). Here, C' can be expressed as C'=C1/(C1+Cpar). "Cpar" is a parasitic capacitance connected to the first gate electrode of the driving element DT. When Cpar is 0, since C' becomes 1, a data transmission rate is high, and the data transmission rate decreases as Cpar increases. The voltage of the third node n3 is the reference voltage Vref, and the voltages of the fourth and fifth nodes n4 and n5 are maintained as the initialization voltage Vinit.

Figure 26:
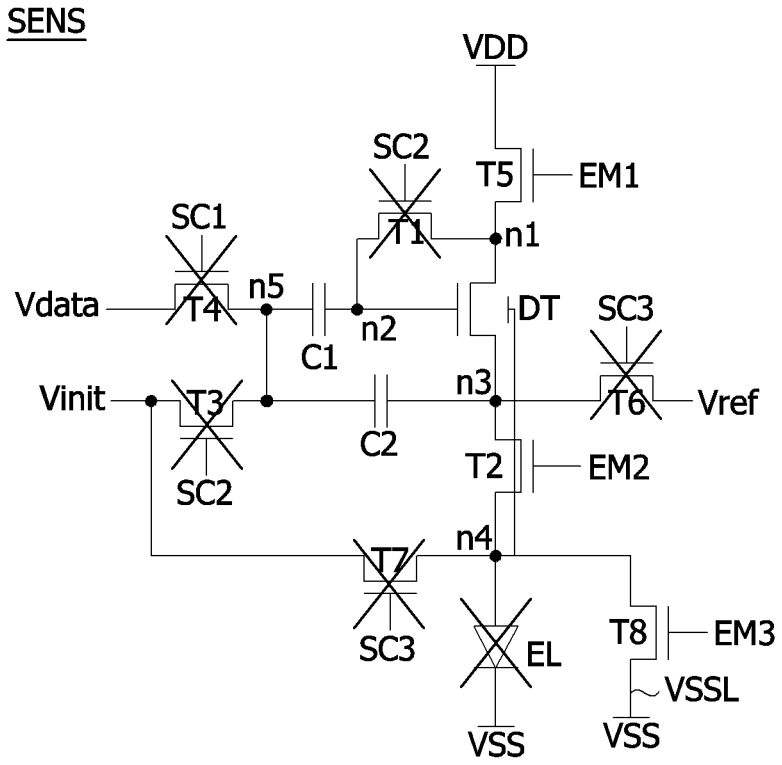
FIG. 26 is a circuit diagram illustrating a sensing operation of the pixel circuit shown in FIG. 21.

FIG. 26 is a circuit diagram illustrating the sensing operation SENS of the pixel circuit shown in FIG. 21.

Referring to FIG. 26, when driving in the sensing mode after the power is turned off, voltages of the scan pulses SC1, SC2, and SC3 in the sensing operation SENS are the gate-off voltage VGL. The first and second EM pulses EM1 and EM2 are generated as the gate-on voltage VEH in at least some sections in the sensing operation SENS. Accordingly, in the sensing operation SENS in which the electrical characteristic of the pixel circuit is sensed, the driving element DT and the second, fifth, and eighth switch elements T2, T5, and T8 are turned on, and the first, third, fourth, sixth, and seventh switch elements T1, T3, T4, T6, and T7 are turned off.

In this case, the light-emitting element EL can be turned off as the current flowing through the pixel voltage line forms a current path through the low voltage line without forming a current path through the light-emitting element EL.

Figure 27:
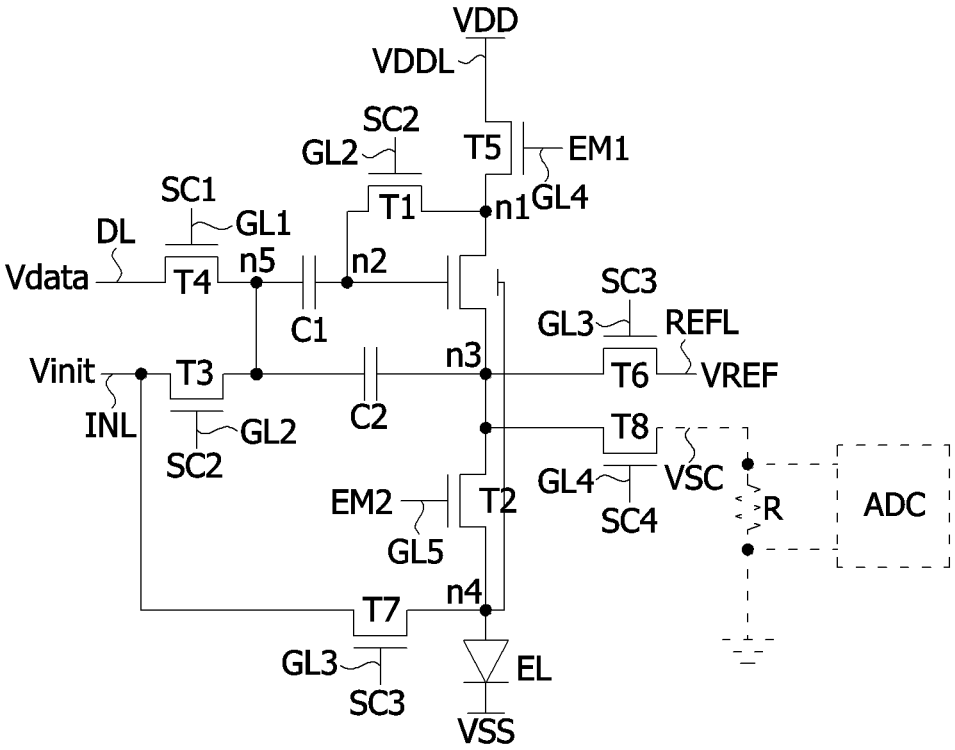
FIG. 27 is a circuit diagram illustrating a pixel circuit according to still another embodiment of the present disclosure.
Figure 28:
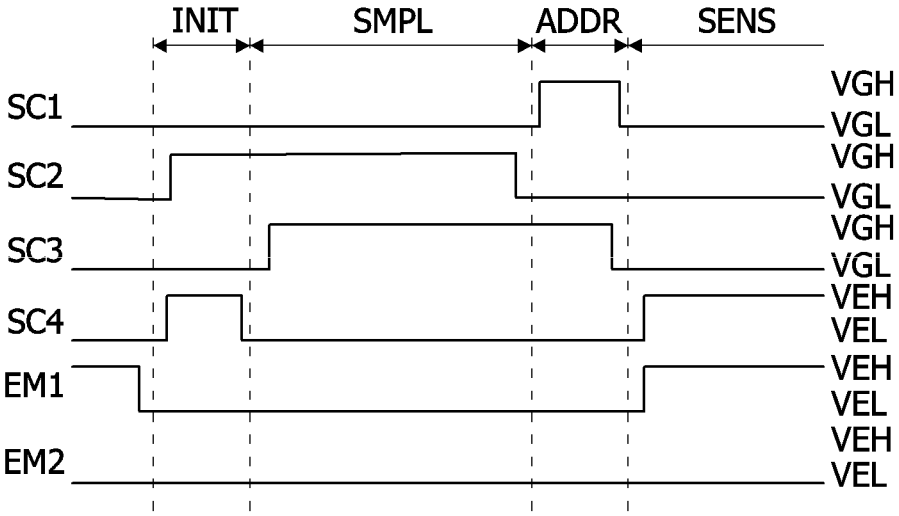
FIG. 28 is a waveform diagram illustrating a driving method of the pixel circuit shown in FIG. 27.

FIG. 27 is a circuit diagram illustrating a pixel circuit according to still another embodiment of the present disclosure, and FIG. 28 is a waveform diagram illustrating a driving method of the pixel circuit shown in FIG. 27.

Referring to FIGS. 27 and 28, the pixel circuit includes a light-emitting element EL, a driving element DT, first and second capacitors C1 and C2, and first to eighth switch elements T1 to T8. The driving element DT and the switch elements T1 to T8 can be implemented as n-channel oxide TFTs.

The pixel circuit here can have the same configurations of the switch elements as the pixel circuit shown in FIG. 21 other than the eighth switch element, and can have the same functions as the pixel circuit shown in FIG. 21.

The eighth switch element T8 includes a first electrode connected to a third node n3, a second electrode connected to a current sensing line VSC, and a gate electrode to which a fourth scan pulse SC4 is applied. The eighth switch element T8 is turned on in the sensing operation SENS in response to a gate-on voltage VEH of the fourth scan pulse SC4 to form a current path between the third node n3 and the current sensing line VSC.

Here, a sensing unit as shown in FIG. 5 can be connected to the current sensing line VSC other than the pixel power line, and thus can sense a current flowing through the current sensing line VSC.

In the present disclosure, when driving in a sensing mode after power of a display device is turned off, light emission of a light-emitting element can be suppressed by sensing a current flowing through a pixel driving voltage line while a current which flows through a power line to which a pixel driving voltage is applied forms a path which bypasses the light-emitting element as a current path.

In the present disclosure, when driving in the sensing mode, since the light emission of the light-emitting element can be suppressed, a visibility limitation can be solved or addressed.

Although the embodiments of the present disclosure have been described in more detail with reference to the accompanying drawings, the present disclosure is not limited thereto and can be embodied in many different forms without departing from the technical concept of the present disclosure. Therefore, the embodiments disclosed in the present disclosure are provided for illustrative purposes only and are not intended to limit the technical concept of the present disclosure. The scope of the technical concept of the present disclosure is not limited thereto. Therefore, it should be understood that the above-described embodiments are illustrative in all aspects and do not limit the present disclosure. The protective scope of the present disclosure should be construed based on the following claims, and all the technical concepts in the equivalent scope thereof should be construed as falling within the scope of the present disclosure.

What is claimed is:

1. A gate driver comprising:

a first circuit unit configured to charge or discharge voltages of a first control node and a second control node according to an input signal; and a second circuit unit configured to transmit a first clock signal and a first low potential voltage to a first output node according to the voltages of the first control node and the second control node to output a gate signal to the first output node, wherein a voltage of the first clock signal and a voltage of the first low potential voltage vary according to a mode of a pixel circuit, and wherein the voltage of the first clock signal and the voltage of the first low potential voltage both maintain an on voltage in which a switch element of the pixel circuit is turned on based on the gate signal in a sensing mode in which an electrical characteristic of the pixel circuit is sensed.

2. The gate driver of claim 1, wherein the first clock signal swings between a high voltage and a low voltage, and the first low potential voltage is the low voltage in a display mode in which the pixel circuit emits light according to pixel data, and the voltage of the first clock signal maintains the high voltage and the first low potential voltage is the high voltage in the sensing mode in which the electrical characteristic of the pixel circuit is sensed.

3. The gate driver of claim 1, wherein the second circuit unit includes:

a first buffer transistor including a gate connected to the first control node, a first electrode to which the first clock signal is applied, and a second electrode connected to the first output node; and a second buffer transistor including a gate connected to the second control node, a first electrode connected to the first output node, and a second electrode to which the first low potential voltage is applied.

4. The gate driver of claim 1, wherein the gate signal includes a sensing signal and a scan signal, and the second circuit unit includes:

a second-a circuit unit configured to transmit the first clock signal and the first low potential voltage to the first output node according to the voltages of the first control node and the second control node to output the sensing signal to the first output node;

a second-b circuit unit configured to transmit a second clock signal and a second low potential voltage to a second output node according to the voltages of the first control node and the second control node to output the scan signal to the second output node; and a second-c circuit unit configured to transmit a third clock signal and a third low potential voltage to a third output node according to the voltages of the first control node and the second control node to output a carry signal to the third output node.

5. The gate driver of claim 4, wherein the voltage of the first clock signal maintains a high voltage, and the first low potential voltage is the high voltage in the sensing mode in which the electrical characteristic of the pixel circuit is sensed.

6. The gate driver of claim 1, wherein the first control node includes a first-a control node and a first-b control node, the second control node includes a second-a control node and a second-b control node, and the first circuit unit includes:

a first-a circuit unit configured to charge or discharge the first-a control node and the second-a control node; and a first-b circuit unit configured to charge or discharge the first-b control node and the second-b control node.

7. The gate driver of claim 6, wherein the gate signal includes a sensing signal and a scan signal, and the second circuit unit includes:

a second-a circuit unit having a second-a1 circuit unit configured to transmit the first clock signal and the first low potential voltage to the first output node according to voltages of the first-a control node and the second-a control node to output the sensing signal to the first output node, and a second-a2 circuit unit configured to transmit a third-a clock signal and a third-a low potential voltage to a third-a output node to output a first-a carry signal to the third-a output node; and a second-b circuit unit having a second-b1 circuit unit configured to transmit a second clock signal and a second low potential voltage to a second output node according to voltages of the first-b control node and the second-b control node to output the scan signal to the second output node, and a second-b2 circuit unit configured to transmit a third-b clock signal and a third-b low potential voltage to a third-b output node to output a first-b carry signal to the third-b output node.

8. The gate driver of claim 7, wherein the first low potential voltage is a high voltage in the sensing mode in which the electrical characteristic of the pixel circuit is sensed.

9. The gate driver of claim 6, wherein the gate signal includes a sensing signal and a scan signal, and the second circuit unit includes:

a second-a circuit unit configured to transmit the first clock signal and the first low potential voltage to the first output node according to voltages of the first-a control node and the second-a control node to output the sensing signal and a first-a carry signal to the first output node; and a second-b circuit unit configured to transmit a second clock signal and a second low potential voltage to a second output node according to voltages of the first-b control node and the second-b control node to output the scan signal and a first-b carry signal to the second output node.

10. The gate driver of claim 9, wherein the voltage of the first clock signal maintains a high voltage, and the first low potential voltage is the high voltage in the sensing mode in which the electrical characteristic of the pixel circuit is sensed.

11. A display device comprising:

a data driver configured to output a data voltage;

a gate driver including a first circuit unit configured to charge or discharge voltages of a first control node and a second control node according to an input signal, and a second circuit unit configured to transmit a first clock signal and a first low potential voltage to a first output node according to the voltages of the first control node and the second control node to output a gate signal to the first output node; and a plurality of pixel circuits configured to receive the data voltage and the gate signal to reproduce an input image, wherein a voltage of the first clock signal and a voltage of the first low potential voltage vary according to a mode of one pixel circuit among the plurality of pixel circuits, and wherein the voltage of the first clock signal and the voltage of the first low potential voltage both maintain an on voltage in which a switch element of the pixel circuit is turned on based on the gate signal in a sensing mode in which an electrical characteristic of the pixel circuit is sensed.

12. The display device of claim 11, wherein the first clock signal swings between a high voltage and a low voltage, and the first low potential voltage is the low voltage in a display mode in which the one pixel circuit emits light according to pixel data, and the voltage of the first clock signal maintains the high voltage and the first low potential voltage is the high voltage in the sensing mode in which the electrical characteristic of the one pixel circuit is sensed.

13. The display device of claim 11, wherein the one pixel circuit includes:

a driving element having a gate connected to a first node, a first electrode to which a high potential voltage is applied, and a second electrode connected to a second node;

a light-emitting element including an anode connected to the second node and a cathode to which a low potential power voltage is applied to be driven according to a current from the driving element;

a first switch element including a first electrode to which a data voltage is applied, a second electrode connected to the first node, and a gate electrode to which a scan pulse is applied; and a second switch element including a first electrode connected to the second node, a second electrode connected to a reference voltage, and a gate electrode to which a sense pulse is applied.

14. The display device of claim 13, wherein the second switch element is turned on in the sensing mode in which the electrical characteristic of the one pixel circuit is sensed.

15. The display device of claim 11, wherein the one pixel circuit includes:

a driving element including a first electrode connected to a first node, a first gate electrode connected to a second node, a second electrode connected to a third node, and a second gate electrode to which a preset voltage is applied;

a light-emitting element including an anode connected to a fourth node and a cathode to which a low potential power voltage is applied to be driven according to a current from the driving element;

a first switch element connected between the first node and the second node;

a second switch element connected between the third node and the fourth node;

a third switch element including a first electrode to which an initialization voltage is applied, a second electrode connected to a fifth node, and a gate electrode to which a second scan pulse is applied;

a fourth switch element including a first electrode to which the data voltage is applied, a second electrode connected to the fifth node, and a gate electrode to which a first scan pulse is applied;

a fifth switch element including a first electrode to which a pixel driving voltage is applied, a second electrode connected to the first node, and a gate electrode to which a first EM pulse is applied;

a sixth switch element including a first electrode to which a reference voltage is applied, a second electrode connected to the third node, and a gate electrode to which a third scan pulse is applied;

a seventh switch element including a first electrode to which the initialization voltage is applied, a second electrode connected to the fourth node, and a gate electrode to which the third scan pulse is applied;

an eighth switch element including a first electrode connected to the fourth node, a second electrode to which the low potential power voltage is applied, and a gate electrode to which a third EM pulse is applied;

a first capacitor including a first electrode connected to the fifth node and a second electrode connected to the second node; and a second capacitor including a first electrode connected to the fifth node and a second electrode connected to the third node.

16. The display device of claim 11, wherein the one pixel circuit includes:

a driving element including a first electrode connected to a first node, a first gate electrode connected to a second node, a second electrode connected to a third node, and a second gate electrode to which a preset voltage is applied;

a light-emitting element including an anode connected to a fourth node and a cathode to which a low potential power voltage is applied to be driven according to a current from the driving element;

a first switch element connected between the first node and the second node;

a second switch element connected between the third node and the fourth node;

a third switch element including a first electrode to which an initialization voltage is applied, a second electrode connected to a fifth node, and a gate electrode to which a second scan pulse is applied;

a fourth switch element including a first electrode to which the data voltage is applied, a second electrode connected to the fifth node, and a gate electrode to which a first scan pulse is applied;

a fifth switch element including a first electrode to which a pixel driving voltage is applied, a second electrode connected to the first node, and a gate electrode to which a first EM pulse is applied;

a sixth switch element including a first electrode to which a reference voltage is applied, a second electrode connected to the third node, and a gate electrode to which a third scan pulse is applied;

a seventh switch element including a first electrode to which the initialization voltage is applied, a second electrode connected to the fourth node, and a gate electrode to which the third scan pulse is applied;

an eighth switch element including a first electrode connected to the third node, a second electrode connected to a current sensing line, and a gate electrode to which a fourth scan pulse is applied;

a first capacitor including a first electrode connected to the fifth node and a second electrode connected to the second node; and a second capacitor including a first electrode connected to the fifth node and a second electrode connected to the third node.

17. The display device of claim 15, wherein the first switch element includes a first electrode connected to the first node, a second electrode connected to the second node, and a gate electrode to which the second scan pulse is applied, and the second switch element includes a first electrode connected to the third node, a second electrode connected to the fourth node, and a gate electrode to which a second EM pulse is applied.

18. The display device of claim 11, wherein all transistors in a panel including the data driver, the gate driver, and the plurality of pixel circuits are implemented with oxide thin film transistors (TFTs) including an n-channel type oxide semiconductor.

19. A gate driver comprising:

a first circuit unit configured to charge or discharge voltages of a first control node and a second control node according to an input signal; and a second circuit unit configured to transmit a first clock signal and a first low potential voltage to a first output node according to the voltages of the first control node and the second control node to output a gate signal to the first output node, wherein a voltage of the first clock signal and a voltage the first low potential voltage vary according to a mode of a pixel circuit, and wherein the first clock signal swings between a high voltage and a low voltage, and the first low potential voltage is the low voltage in a display mode in which the pixel circuit emits light according to pixel data, and the voltage of the first clock signal maintains the high voltage and the first low potential voltage is the high voltage in a sensing mode in which an electrical characteristic of the pixel circuit is sensed.

* * * * *